US008333049B2

(12) United States Patent
Badger

(10) Patent No.: US 8,333,049 B2
(45) Date of Patent: Dec. 18, 2012

(54) DOOR ASSEMBLY USING A TWO PIECE END CAP

(75) Inventor: Chad Badger, Fredericksburg, OH (US)

(73) Assignee: Provia Door, Inc., Sugarcreek, OH (US)

( * ) Notice: Subject to any disclaimer, the term of this patent is extended or adjusted under 35 U.S.C. 154(b) by 54 days.

(21) Appl. No.: 12/944,786

(22) Filed: Nov. 12, 2010

(65) Prior Publication Data

US 2011/0061308 A1 Mar. 17, 2011

Related U.S. Application Data

(63) Continuation-in-part of application No. 12/168,452, filed on Jul. 7, 2008.

(51) Int. Cl.
*E04C 2/54* (2006.01)

(52) U.S. Cl. ..... 52/784.13; 52/784.1

(58) Field of Classification Search ..... 52/503, 52/784.1, 784.13; 29/897.3
See application file for complete search history.

(56) References Cited

U.S. PATENT DOCUMENTS

| | | | | |
|---|---|---|---|---|
| 2,451,396 | A * | 10/1948 | Macleod | 52/455 |
| 3,252,262 | A * | 5/1966 | Jessen | 52/784.14 |
| 3,786,613 | A * | 1/1974 | Shepheard | 52/784.13 |
| 5,671,580 | A * | 9/1997 | Chou | 52/656.4 |
| 8,171,700 | B2 * | 5/2012 | Barnes | 52/745.15 |

* cited by examiner

*Primary Examiner* — Jeanette E Chapman
*Assistant Examiner* — Daniel Kenny
(74) *Attorney, Agent, or Firm* — McDonald Hopkins LLC

(57) ABSTRACT

This invention relates to a door assembly comprising a pair of door skins which are mechanically secured together to define a top and bottom opening. The top and bottom openings receive an end cap therein to complete the door. The end cap of the present invention is comprised of two separate pieces, namely a locking clip and a beam, whereby the locking clip is slidably engaged with the beam to form the end cap. This allows a manufacturer to form the locking clip with a first material and the beam with a second material, depending on the specific requirements of the door.

20 Claims, 22 Drawing Sheets

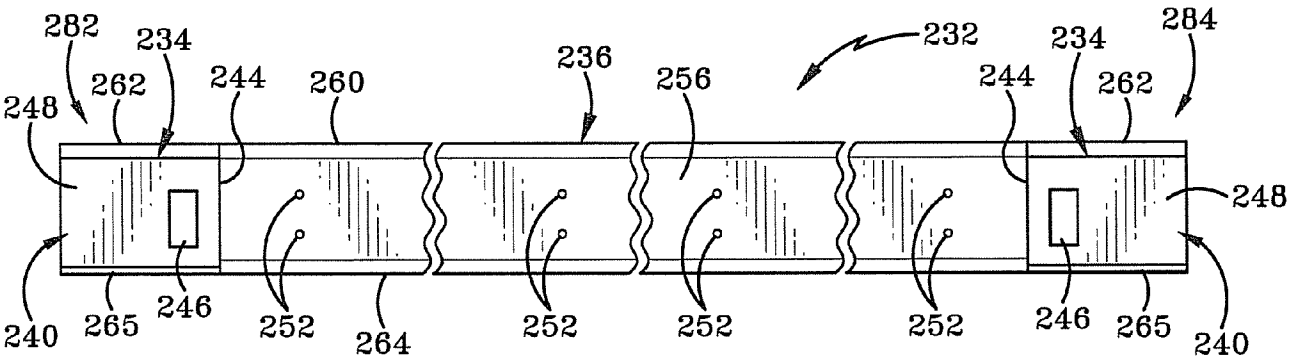
FIG-26
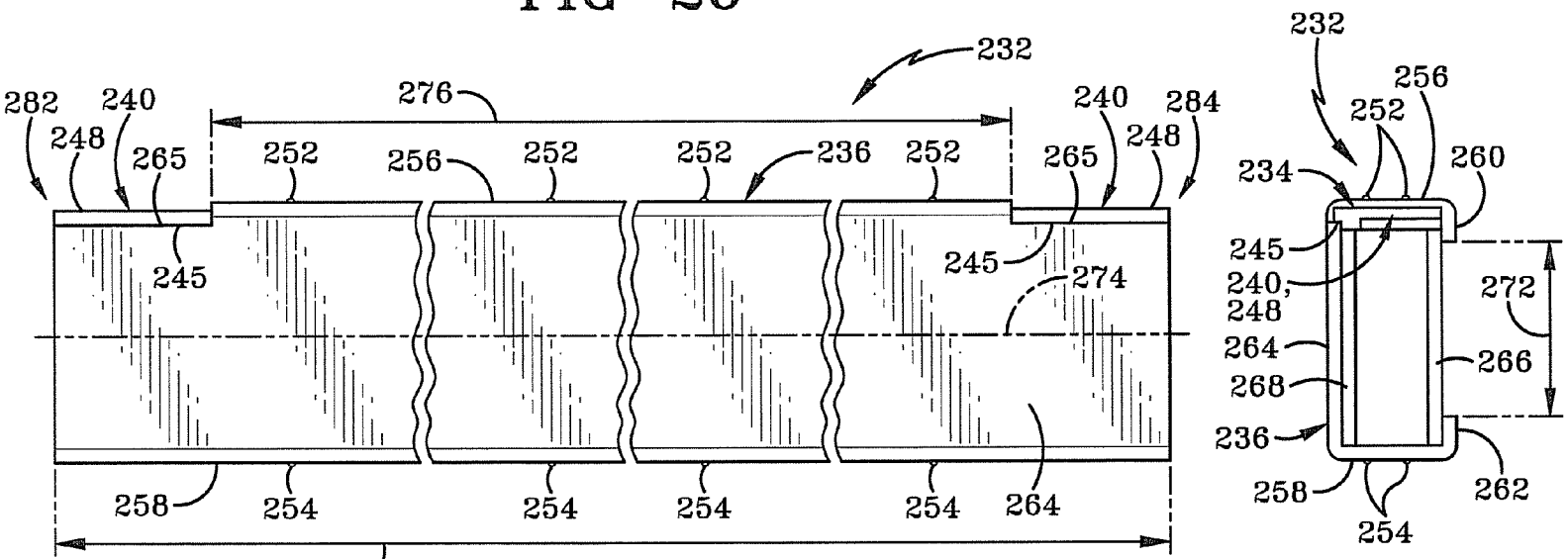
FIG-28
FIG-27

DOOR ASSEMBLY USING A TWO PIECE END CAP

CROSS REFERENCE TO RELATED APPLICATION

This application is a Continuation-In-Part of U.S. patent application Ser. No. 12/168,452, filed Jul. 7, 2008; the disclosure of which is incorporated herein by reference.

BACKGROUND OF THE INVENTION

1. Technical Field

The invention relates generally to interlocking door skins and end caps, and a method of forming a door using these elements. More particularly, the invention relates to door skins having a plurality of interlocking tabs which function to secure the door skins as a unit and thereby define an upper opening and a lower opening for placing the end caps therein. Specifically, the invention relates to interlocking door skins which are secured together and formed to accept a top and bottom end cap which are formed by a separate locking clip element secured to a beam element.

2. Background Information

Doors in general, but industrial doors in particular, have suffered from a variety of defects which lead to dangerous operating conditions or unsatisfying build quality. Since wood is generally light and can be shaped and cut easily, wooden doors do not suffer from unsatisfying build quality. Nevertheless, wooden doors cannot withstand the harsh environments required of industrial applications and are therefore inappropriate.

Steel or metal doors, on the other hand, provide strength and the ability to withstand extreme environmental conditions. Due to the heavy material, the metal doors generally have a hollow cavity in order to substantially reduce the overall weight.

Traditionally, the metal door was manufactured with two door skins if the top and bottom pieces were manufactured integral to the respective door skins or four pieces if the top and bottom pieces were not integral to one of the door skins. One traditional method of manufacturing the door is to weld the pieces together at the seams. The welded door provides great resistance to the harsh environment and can generally withstand fires, but suffers from being a time consuming and costly procedure as well as unattractive.

The welded door is unattractive due to the welded seams which contain a variety of bumps and ridges from the welding process. Further, the welding process is generally unreliable and may cause material flexing and fitment issues due to the extreme heat required to weld the door together. Finally, the welded door is costly to produce because an acceptable door must be prepped for welding and then welded. Not only is welding expensive and time consuming, the unattractive seams that result must be sanded and polished to provide an acceptable finish. The sanding and polishing procedures are objectionable because they are both labor intensive and messy.

A second method of manufacturing a metal door is to use an adhesive. While the adhesive is easier, cheaper, and faster than welding, the adhesive is unable to endure the high heat of a fire and will melt, thereby posing a safety hazard. The process of adhering the doors skins with an adhesive still takes more time than is desired because the skins cannot be glued and then moved to the next processing station, but instead must remain untouched until the adhesive hardens. Further, if the doors are moved before the adhesive hardens, then the door skins will not be properly aligned and the door may have to be scraped, thereby increasing production costs. Thus there is a demonstrated need for an interlocking door assembly which is capable of being produced quickly and efficiently without welding and is able to withstand harsh environments as well as the extreme heat of a fire.

Furthermore, traditional monolithic end caps are difficult to manufacture due to the conflicting requirements of the end cap. The end cap should be manufactured from a durable material to conform to the overall strength and appearance of the metal door. Conversely, the end cap also requires the formation of intricate connecting elements thereon to connect the end cap to the door skins. Therefore, the main portion of the end cap should be formed from a durable material, yet the connecting should be formed from a more formable material, such as plastic. In addition, the end cap should also provide a thermal break in the metal material which forms the front and rear door surfaces. Metal material is desired due to its durability, yet the thermal conductivity of metal is such that thermal energy is easily transferred between the front and back door surfaces. For example, cold outdoor temperatures may be transferred to the interior facing door surface through the end caps and thereby act to cool the interior of the building, thus increasing heating costs for the building owner. As such, it is desirable that the end cap be formed of a material which has the property of low thermal conductivity, thus transfer of thermal energy through the door will be minimized. Therefore, there is a demonstrated need for a non-monolithic end cap which may be formed from two different materials, while also being formed of different materials from the front and rear door panels.

SUMMARY OF THE INVENTION

The door of the present invention comprises a first skin having a first mechanical connection means extending from a first wall and a second mechanical connection means, a second skin having a third mechanical connection means, an end cap having a fourth mechanical connection means, wherein the end cap is secured to the first skin upon sliding engagement of the first mechanical connection means and the fourth mechanical connection means; and wherein the second skin is secured to the first skin upon engagement of the second mechanical connection means and the third mechanical connection means. The engagement of the first mechanical connection means and the fourth mechanical connection means prevents removal of the end cap. The first skin further comprises a stop preventing movement of the end cap beyond the stop. The first mechanical connection means may be at least one locking tab, the second mechanical connection means may be at least one mounting slot, the third mechanical connection means may be at least one protrusion, and the fourth mechanical connection means may be at least one slot. The first mechanical connection means may be at least one slot, the second mechanical connection means may be at least one protrusion, the third mechanical connection means may be at least one mounting slot, and the fourth mechanical connection means may be at least one locking tab. The at least one mounting slot includes a positioning portion and a locking portion wherein the second skin is releasably secured to the first skin upon sliding engagement of the at least one protrusion form the positioning portion to the locking portion. The at least one mounting slot may be a plurality of mounting slots disposed about a periphery of the first skin. The end cap of the present invention includes a plurality of bosses and may be fixedly secured to the first skin with an adhesive and the second skin is fixedly secured to the first skin with an adhesive. The first skin includes at least one locating tab wherein the end cap is releasably secured within the locating tab.

The first skin further includes a second wall generally parallel to and adapted to be spaced away form the first wall by a side wall, wherein the side wall includes at least one axial protrusion, a plurality of sliding locks, and at least one mounting hole. The present invention may further include at least one hinge reinforcement plate having at least one mounting slot, a plurality of locking slots, and at least one securing hole wherein the at least one hinge reinforcement plate is fixedly secured to the side wall upon sliding engagement of the at least one axial protrusion and the at least one mounting slot. The hinge reinforcement plate may be fixedly secured to the side wall upon sliding engagement of the plurality of sliding locks and the plurality of locking slots.

The method of manufacturing a door of the present invention comprises stamping a first skin with at least one locking tab and at least one mounting slot, stamping a second skin with at least one protrusion, stamping an end cap with at least one slot, applying a first layer of adhesive within the first skin, inserting the end cap within the first skin and in contact with the first adhesive, applying a second layer of adhesive on a top side of the end cap and the first skin, and disposing the second skin at least one protrusion within the at least one mounting slot and in contact with the second layer of adhesive. Alternatively, adhesive may be applied to the second skin directly. The method also includes stamping a side wall in the first skin, stamping at least one axial protrusion, a plurality of sliding locks, and at least one mounting hole in the side wall, and disposing a hinge reinforcement plate on the at least one axial protrusion and the plurality of sliding locks. The method further includes stamping a positioning portion and a locking portion in the at least one mounting slot and urging the second skin at least one protrusion within the at least one mounting slot from the positioning portion to the locking portion.

BRIEF DESCRIPTION OF THE DRAWINGS

The preferred embodiments of the invention, illustrative of the best modes in which Applicant has contemplated applying the principles of the invention, are set forth in the following description and are shown in the drawings.

FIG. 26 is a top elevational view thereof;

FIG. 27 is a side elevational view thereof;

FIG. 28 is an end elevational view thereof;

Similar numbers refer to similar parts throughout the drawings.

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
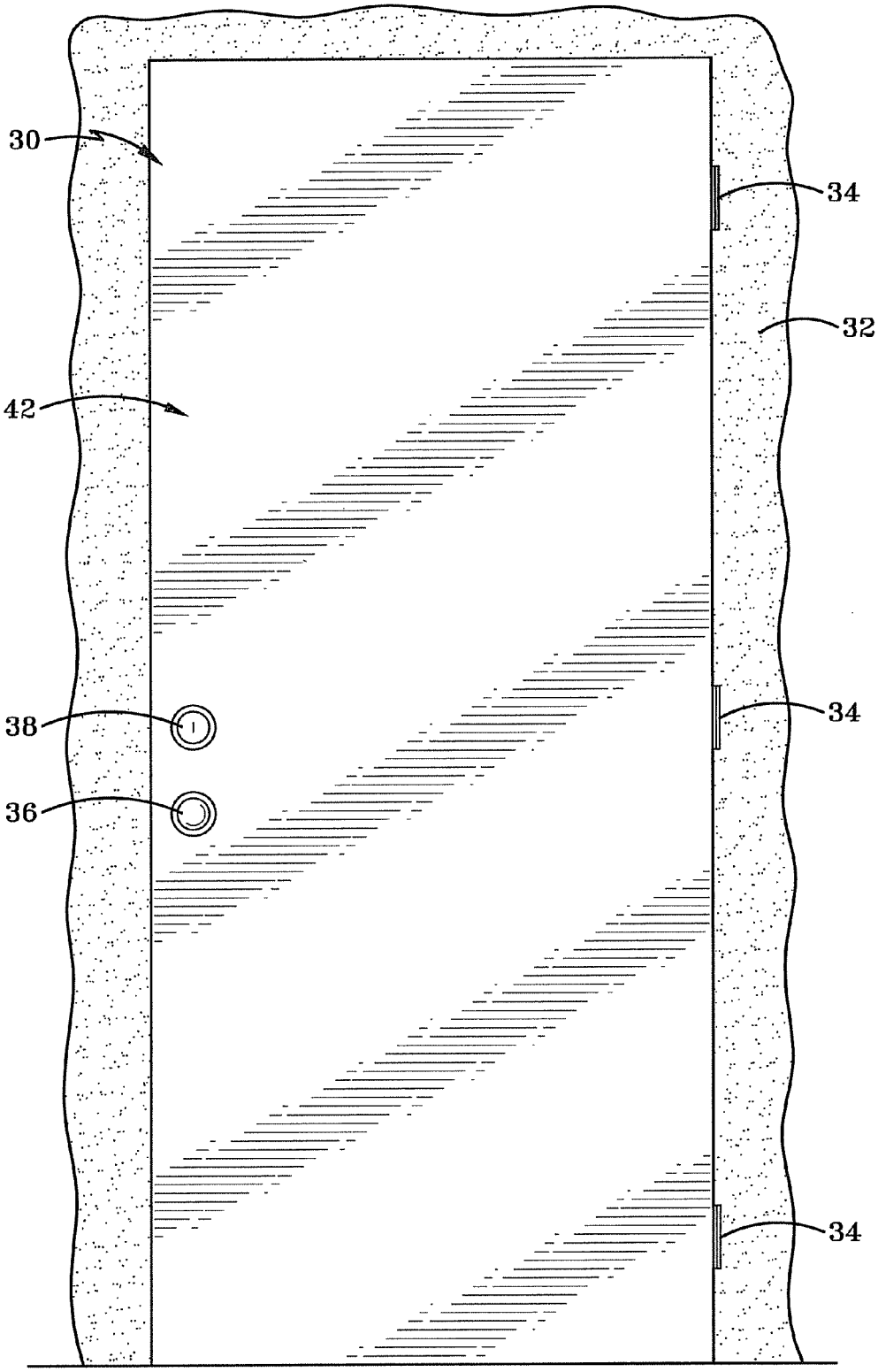
FIG. 1 is a front view of a first embodiment interlocking door assembly with hinges.
Figure 2:
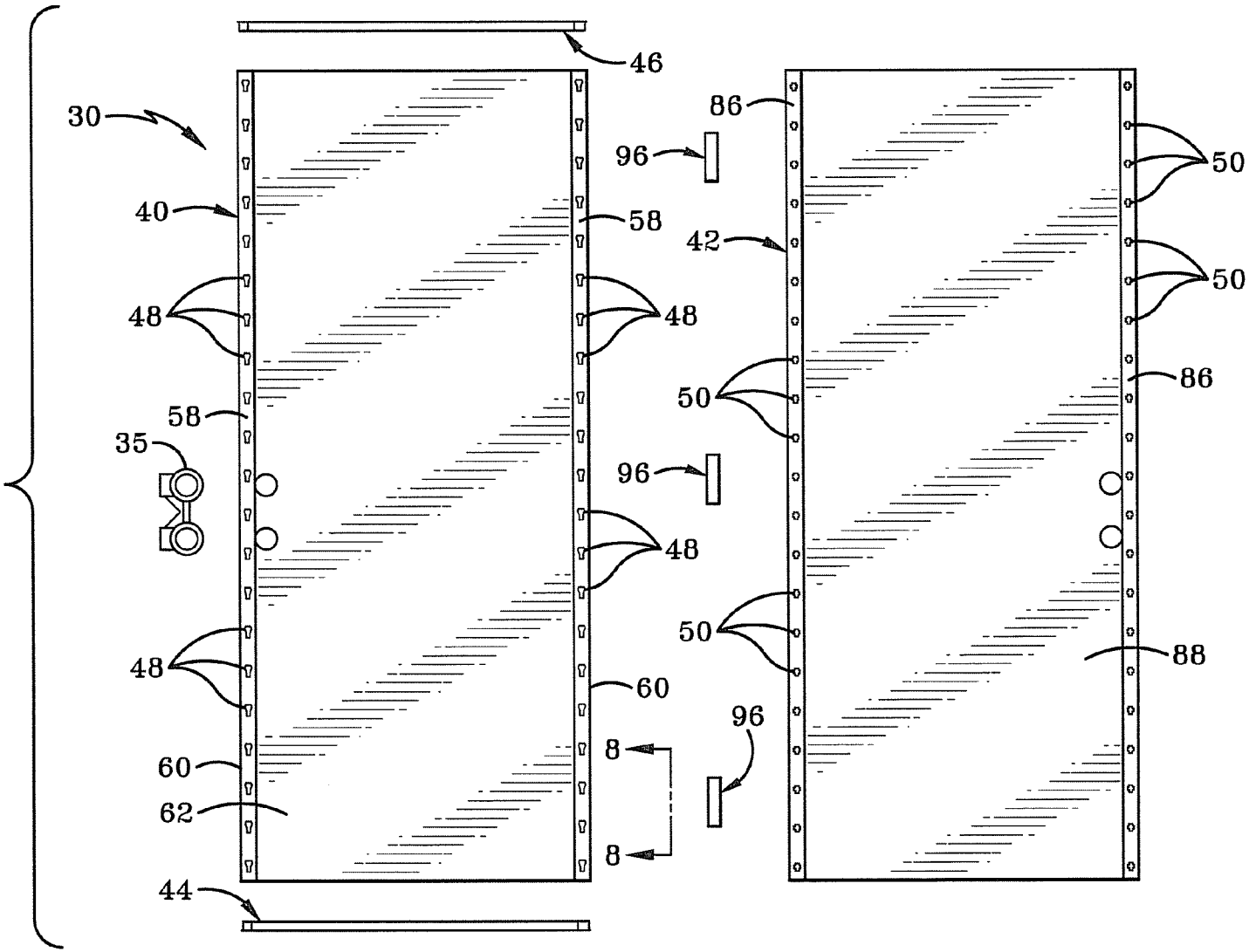
FIG. 2 is an exploded view of the first embodiment interlocking door assembly.

The interlocking door of the present invention is indicated generally at door assembly 30, as is particularly shown in FIGS. 1 and 2. Door assembly 30 is mounted to wall 32 with hinges 34. Similar to a traditional door, door assembly 30 may include housing 35 for mounting door handle 36 and deadbolt 38.

In accordance with one of the main features of the invention, door assembly 30 generally includes base skin 40, top skin 42, lower end cap 44, and upper end cap 46. Base skin 40 includes mounting slots 48 and top skin 42 includes protrusions 50.

Figure 3:
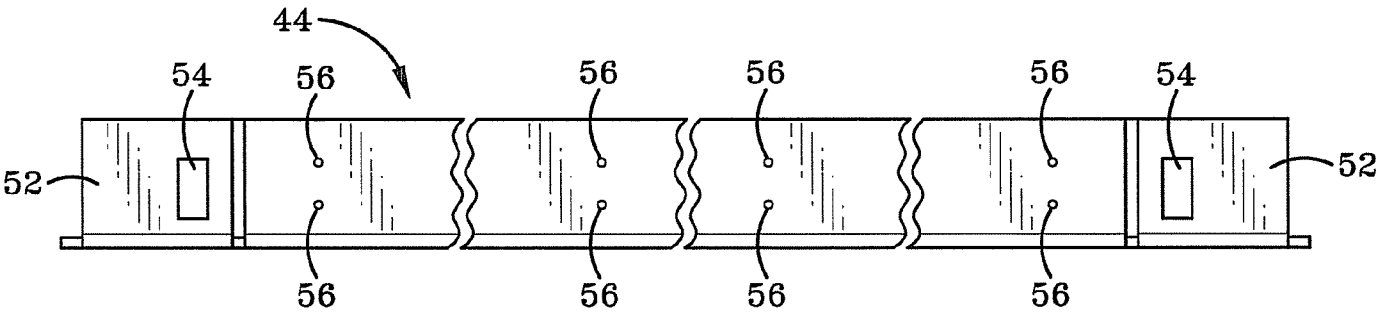
FIG. 3 is a top view of the first embodiment end rail with bosses and mounting slots.
Figure 4:
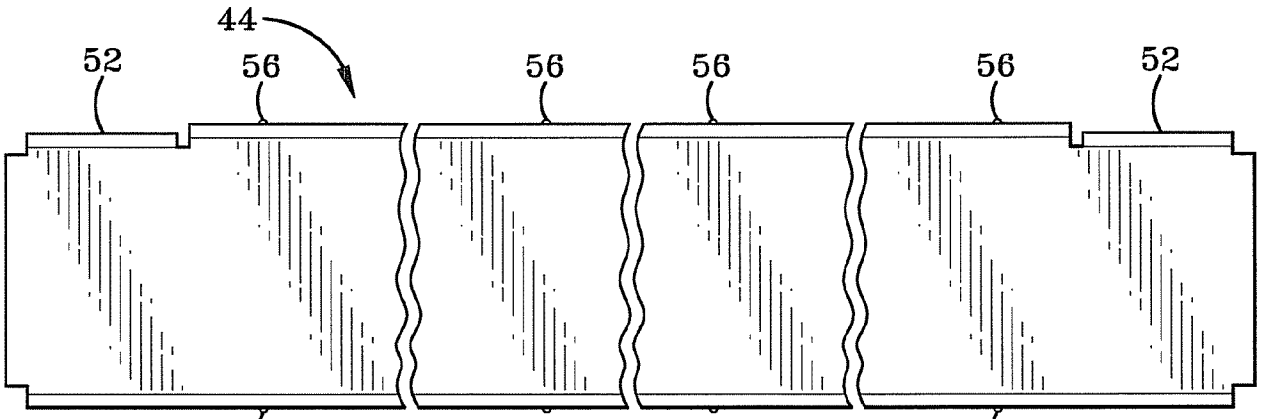
FIG. 4 is a side view of the first embodiment end rail with bosses.
Figure 5:
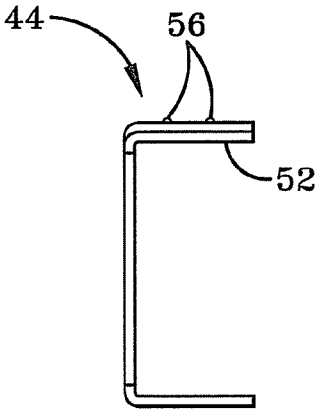
FIG. 5 is an endwise side view of the first embodiment end rail with bosses.

Averting now to FIGS. 3, 4, and 5, lower end cap 44 preferably includes fastening ends 52 with slots 54. The lower end cap 44 further includes bosses 56 located between fastening ends 52 on both the top and bottom sides of the end cap 44 to provide a gap for an adhesive. Advantageously, fastening ends 52 are slightly smaller than the endwise opening of the base skin 40 (described infra) to allow the fastening ends 52 to fit securely within the base skin 40 endwise opening. The lower end cap 44 may be composed of steel, stainless steel, aluminum, polycarbonate, or any other suitable plastic or metal composition. The foregoing description of lower end cap 44 is applicable to upper end cap 46 which is both structurally and functionally similar.

Figure 8:
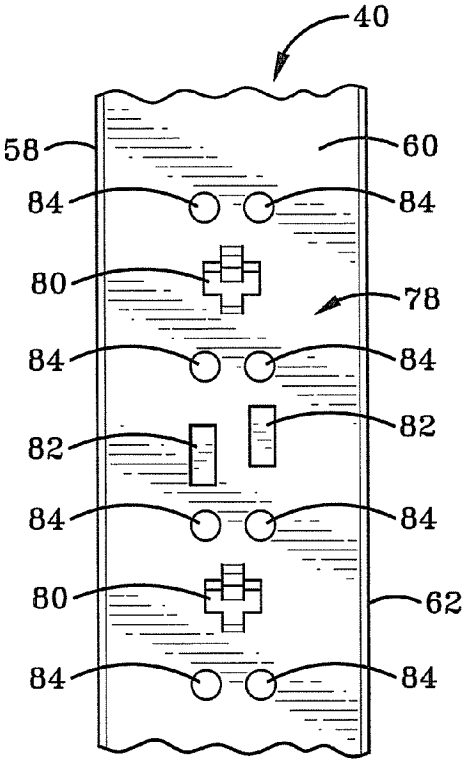
FIG. 8 is an enlarged side view of the first embodiment of the securing assembly of a hinge reinforcement portion of a base skin taken generally along line 8-8 in FIG. 2.
Figure 6:
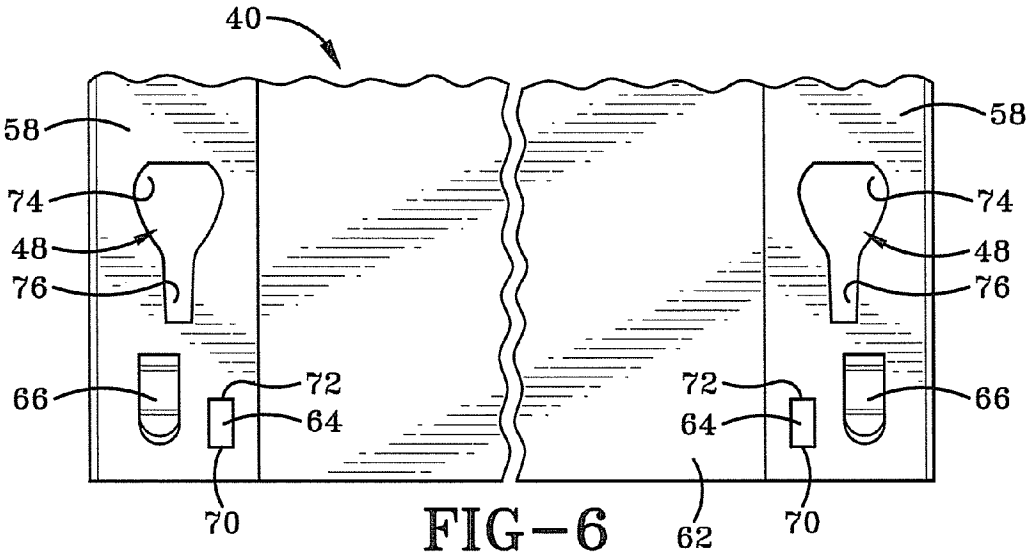
FIG. 6 is an enlarged front view of the first embodiment base skin with mounting slots.
Figure 7:
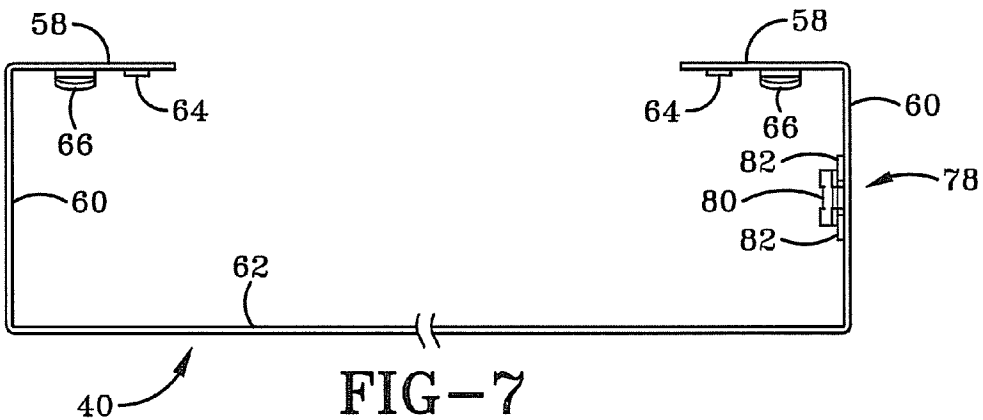
FIG. 7 is an endwise view of the first embodiment base skin with mounting slots.
Figure 12:
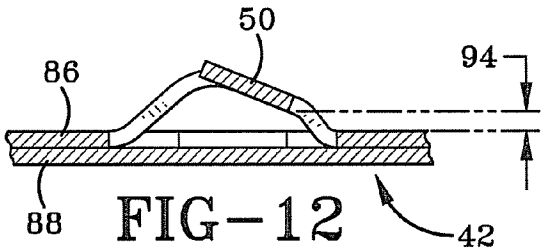
FIG. 12 is a sectional view of the first embodiment mounting protrusion taken generally along line 12-12 in FIG. 9.
Figure 11:
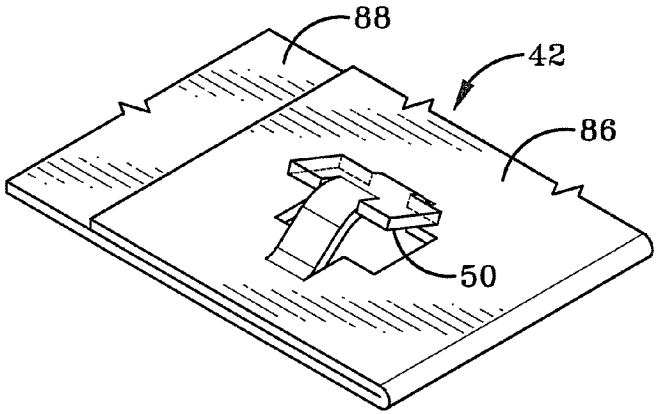
FIG. 11 is an enlarged perspective view of the first embodiment mounting protrusion.
Figure 9:
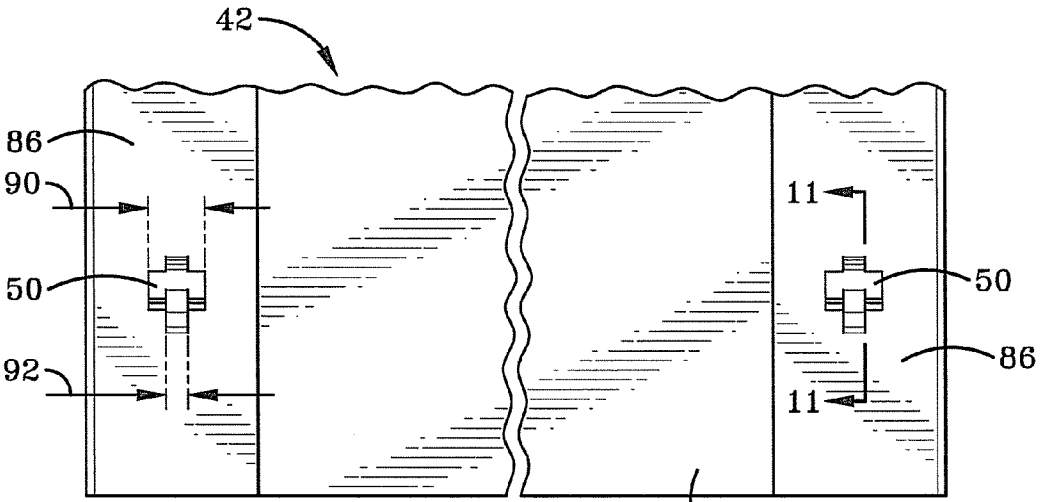
FIG. 9 is an enlarged front view of the first embodiment top skin with mounting protrusions.
Figure 10:
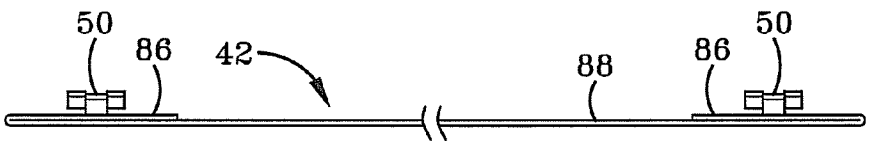
FIG. 10 is an endwise view of the first embodiment top skin with mounting protrusions.

In accordance with another the main features of the invention, FIGS. 6, 7, and 8 illustrate various views of base skin 40. The base skin 40 includes first wall 58, side walls 60, and second wall 62. In a first embodiment, the first wall 58 and second walls 62 are generally parallel and spaced apart a distance approximately equal to the length of the side walls 60. In addition, side walls 60 are generally perpendicular to both the first wall 58 and second wall 62.

First wall 58 includes locking tab 64, locating tab 66, and mounting slots 48. Locking tab 64 has a first end 70 and second end 72. Preferably, first end 70 is generally parallel and located on the same plane as first wall 58. Second end 72 is preferably located above or below the plane of the first wall 58 and is generally offset from first wall 58. Similar to locking tab 64, locating tab 66 includes a depressed end a flush end. However, the depressed and flush ends of locating tab 66 are generally the opposite of the locking tab ends and function only to limit the distance an object may be inserted within the base skin 40 and to facilitate alignment of the inserted object. In a first embodiment, mounting slots 48 are generally located about the periphery of the base skin 40 and include positioning portion 74 and locking portion 76 arranged to receive the protrusions of the top skin 42.

Referring to FIG. 8, hinge reinforcement area 78 incorporates axial protrusions 80, sliding locks 82, and mounting holes 84. Sliding locks 82, similar to locking tab 64, has a first end which is generally flush with side wall 60 and a second end opposite the first end which is depressed or raised from side wall 60. Preferably, sliding locks 82 are opposed to one another, meaning that the flush end of one sliding lock 82 is adjacent to the raised end of another sliding lock 82. Finally, side wall 60 includes mounting holes 84 which are arranged to receive screws or bolts and secure hinges 34 as well as a hinge reinforcement plate 96 (described infra). The hinge reinforcement area 78 has been described as a single area, but may be utilized along the side wall at any position where a hinge is located. The base skin may be composed of steel, stainless steel, aluminum, polycarbonate, or any other suitable plastic or metal composition.

Averting now to FIGS. 9, 10, 11, and 12, top skin 42 is shown with protrusions 50 axially extending from a top side. In a first embodiment, top skin 42 includes upper layer 86 parallel to, adjacent to, and generally situated atop lower layer 88. Upper layer 86 may be formed by folding an outer portion of lower layer 88 backwards and on top of lower layer 88. Advantageously, protrusions 50 extend axially from upper layer 86 so that lower layer 88 is a solid, flat wall and is aesthetically pleasing. While the present invention has been described with protrusions 50 extending from an upper layer 86, it is within the spirit and scope of the present invention as claimed to incorporate protrusions 50 extending directly from the lower layer 88, thereby rending the upper layer 86 unnecessary.

Protrusions 50 must be designed and manufactured with certain specifications and tolerances to fit within the base skin 40 mounting slots 48 and still be releasably secured. Width 90 of the protrusions 50 must be less than the width of positioning portion 74 but more than the width of locking portion 76. Width 92 of the protrusions 50 must be less than both positioning portion 74 and locking portion 76. Advantageously, widths 90 and 92 allow the protrusions 50 to be axially disposed within positioning portion 74 and then slid into locking portion 76. Further, height 94 of the protrusions 50 must provide sufficient clearance to allow the base skin 40 to fit between the protrusion 50 and the top skin 42. Widths 90 and 92 and height 94 do not have to be any particular dimensions, but must be collectively scaled with the mounting slots 48 to fit securely within the mounting slots 48. The top skin 42 may be composed of steel, stainless steel, aluminum, polycarbonate, or any other suitable plastic or metal composition.

Figure 13:
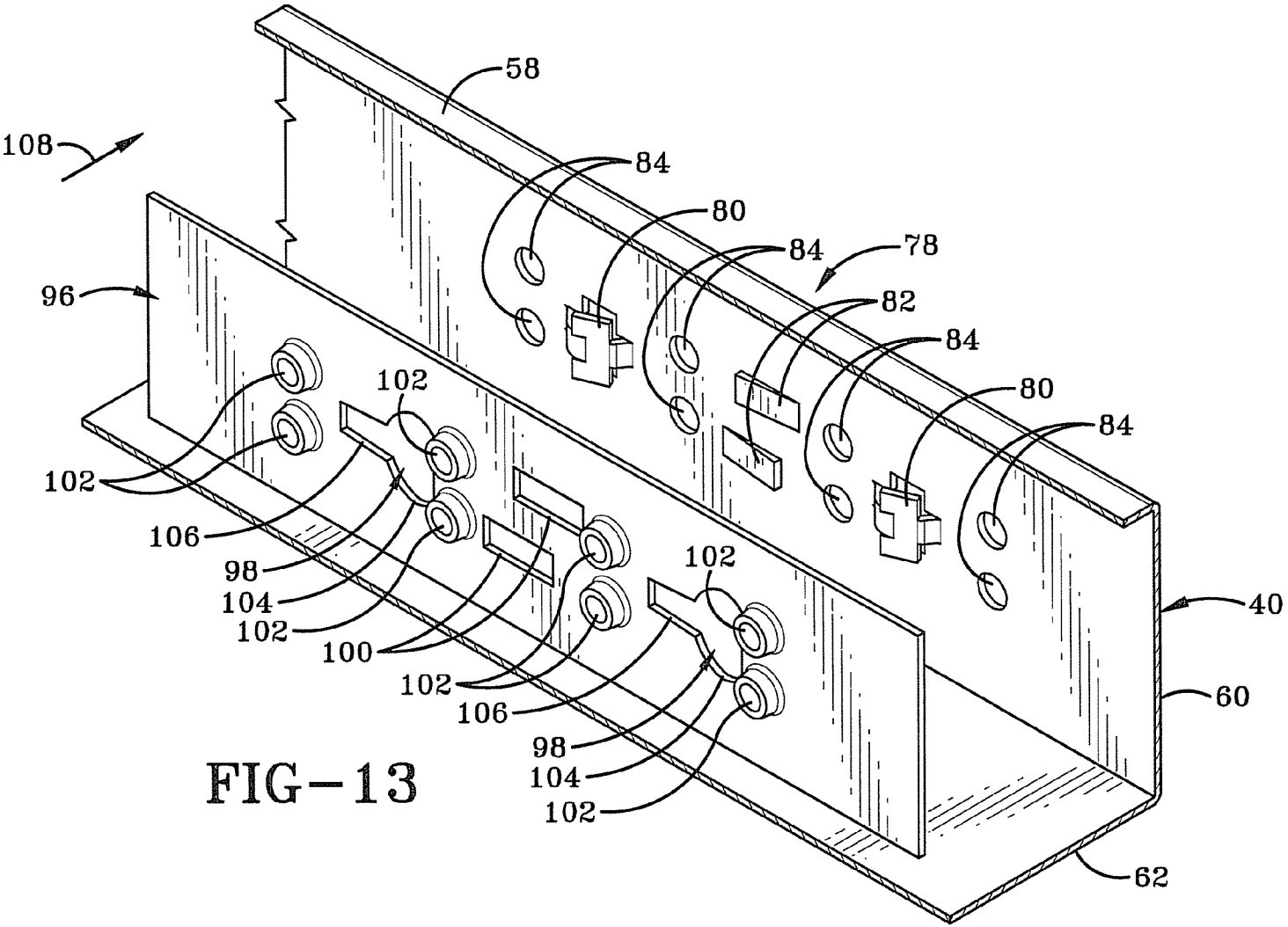
FIG. 13 is a perspective view of the first embodiment hinge reinforcement plate being located on a base skin.

Averting now to FIG. 13, hinge reinforcement plate 96 is illustrated with mounting slots 98, locking slots 100, and securing holes 102. Mounting slots 98 include positioning portion 104 and locking portion 106. Mounting slots 98 are arranged to function similar to the base skin 40 mounting slots 48 and thus the operation and interaction need not be repeated. Further, locking slots 100 are arranged to fit securely around sliding locks 82 to prevent movement of hinge reinforcement plate 96.

Figure 14:
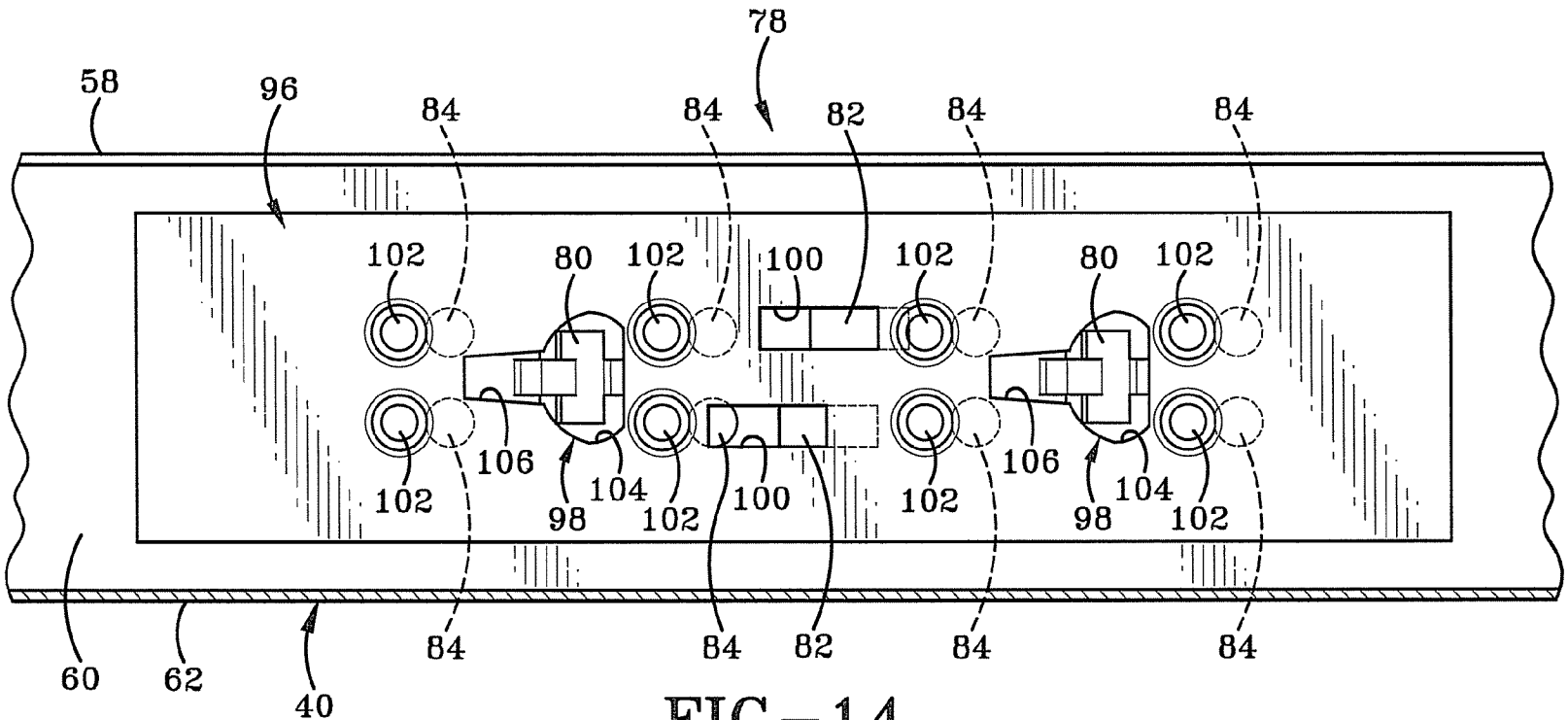
FIG. 14 is a front view of the first embodiment hinge reinforcement plate located on a base skin securing assembly.
Figure 15:
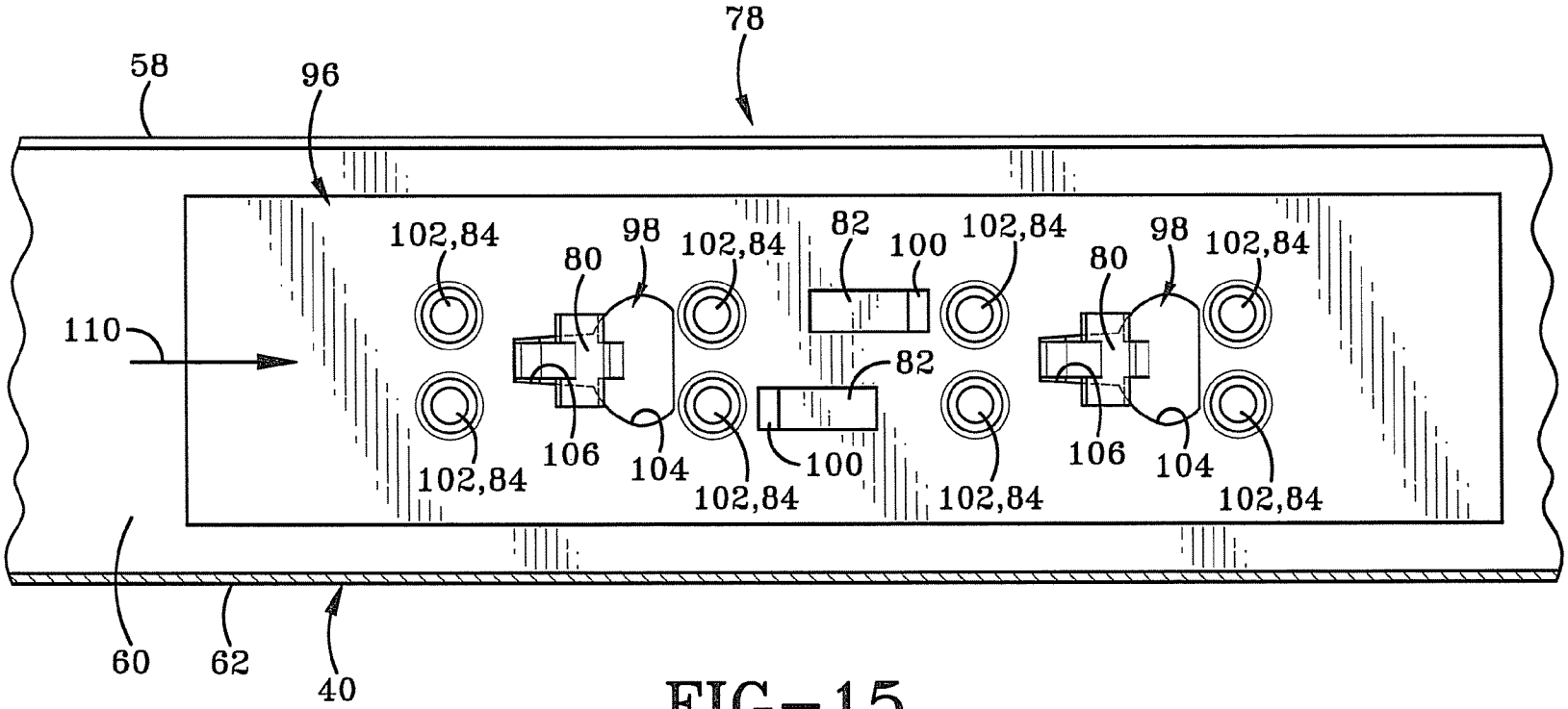
FIG. 15 is a front view of the first embodiment hinge reinforcement plate releasably secured to a base skin.

Having now described the structure of the interlocking door assembly 30, a method of assembling the door will be described in detail. While the following is described as a series of steps, no particular order is to be inferred and is limited only by the appended claims. FIGS. 13, 14, and 15 illustrate hinge reinforcement plate 96 being installed on base skin 40 at side wall 60. Mounting slots 98 of the hinge reinforcement plate 96 are axially disposed on the side wall axial protrusions 50 in the direction indicated by arrow 108. In particular, positioning portion 104 of the mounting slots 48 are axially disposed on axial protrusions 80 in the direction indicated by arrow 108. Next, hinge reinforcement plate 96 is slid in the direction indicated by arrow 110 so that protrusions 80 are located within locking portions 106, sliding locks 82 are secured within locking slots 100, and mounting holes 84 are aligned with securing holes 102.

Figure 16:
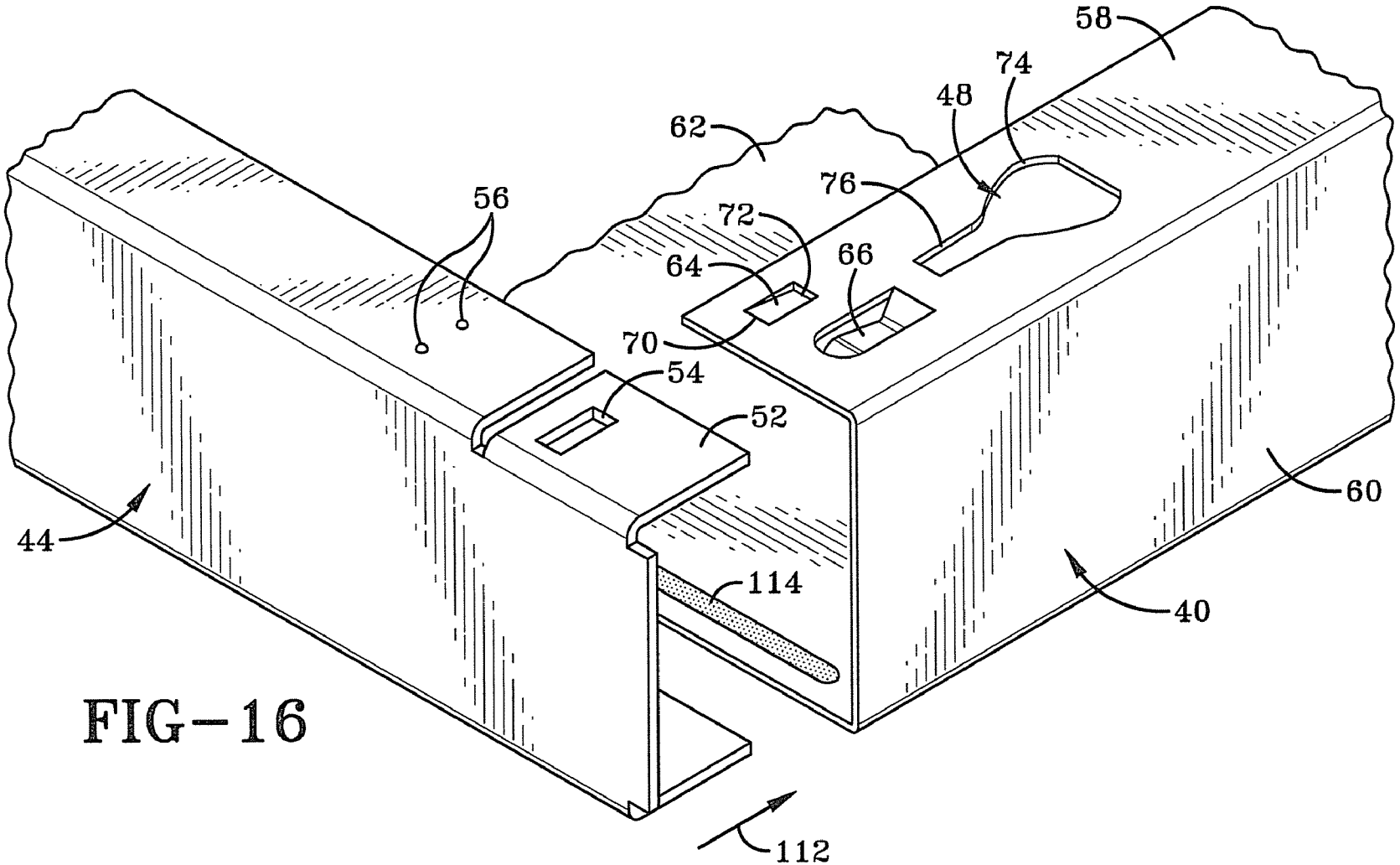
FIG. 16 is a perspective view of a corner of preferred embodiment end rail being secured to a base skin.
Figure 18:
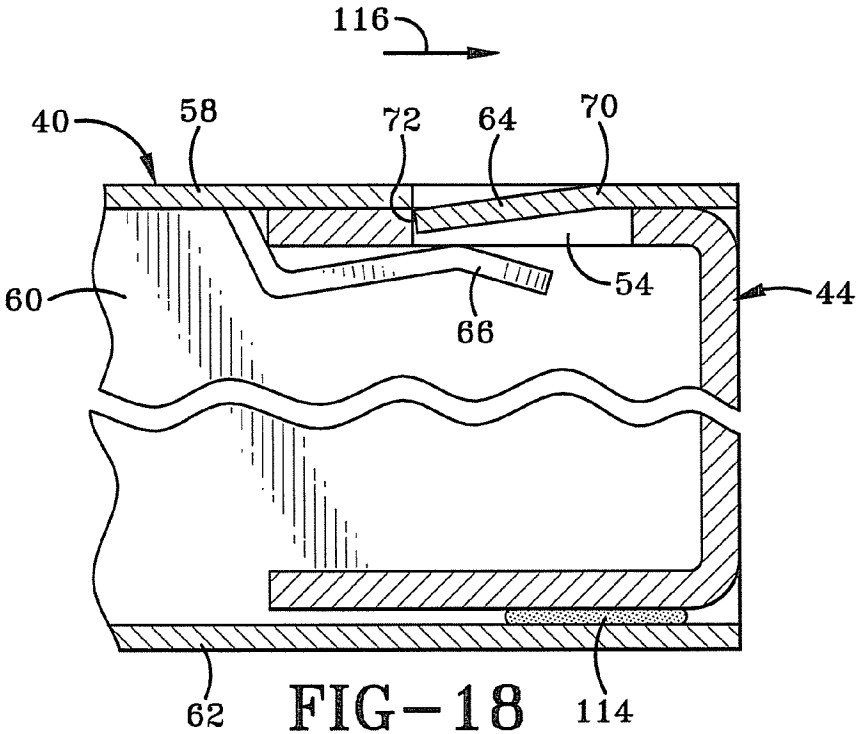
FIG. 18 is a sectional view of the secured end rail and base skin taken generally along line 18-18 in FIG. 17.
Figure 17:
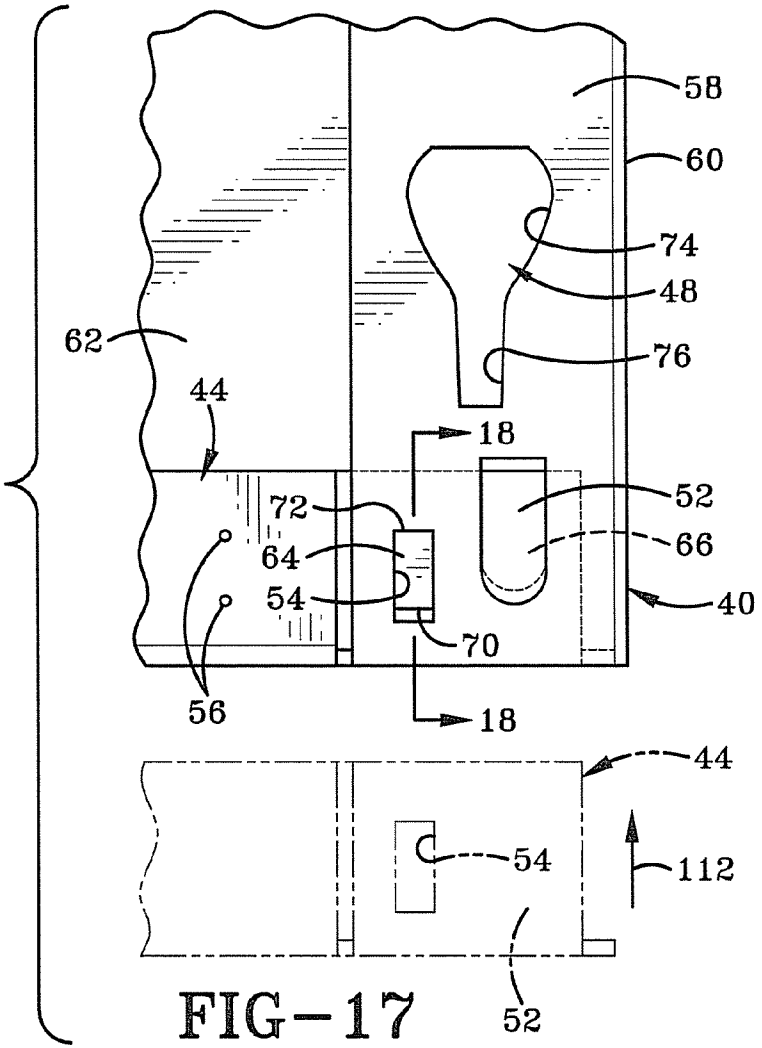
FIG. 17 is a top view of the first embodiment end rail secured to a base skin.

FIG. 16 shows lower end cap 44 being inserted within base skin 40 in the direction indicated by arrow 112. FIGS. 17 and 18 are views of the assembled corner of lower end cap 44 inserted within base skin 40. Prior to installation of lower end cap 44, adhesive 114 is applied to the inside of second wall 62. Fastening end 52 is then inserted within the base skin 40 until the fastening end 52 is secured between the bottom side of first wall 58 and locating tab 66. Further, the lower end cap 44 and base skin 40 are fixedly secured by engagement of slots 54 and locking tab 64, as well as fixedly secured by adhesive 114. As described supra, slot 54 is fixedly secured by second end 72 since the second end is disposed within slot 54 and prevents any movement of the lower end cap 44 in the direction indicated by arrow 116. Thus, the lower end cap 44 may readily be inserted within the base skin 40 but may not be removed and is still fixedly secured within the base skin 40 if the adhesive were to be dissolved or melted. The foregoing description of lower end cap 44 is applicable to upper end cap 46 which is both structurally and functionally similar and is inserted within the base skin 40 in the same manner.

Figure 19:
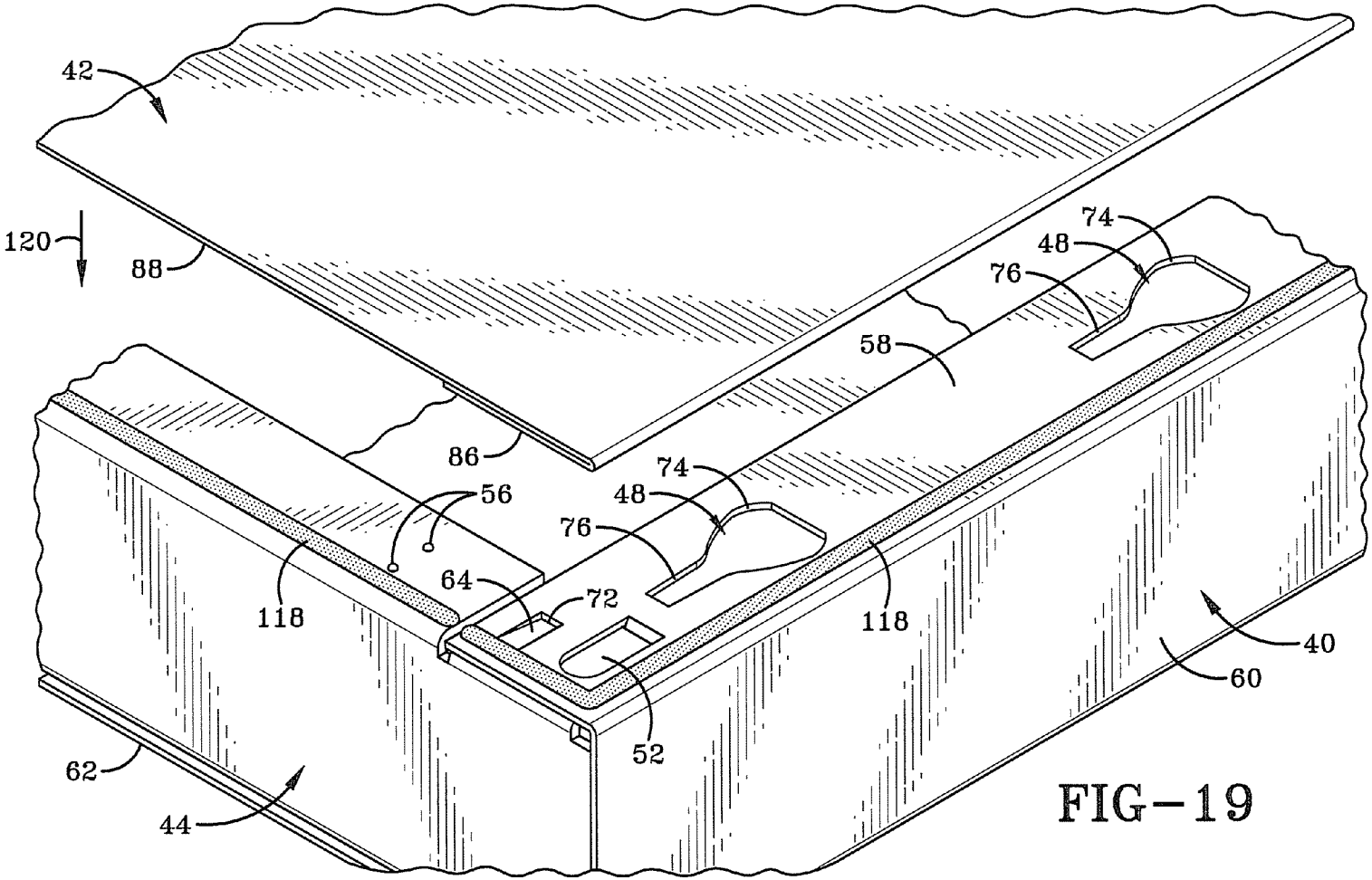
FIG. 19 is a perspective view of a corner of the first embodiment top skin being located on a combined base skin and end rail.
Figure 20:
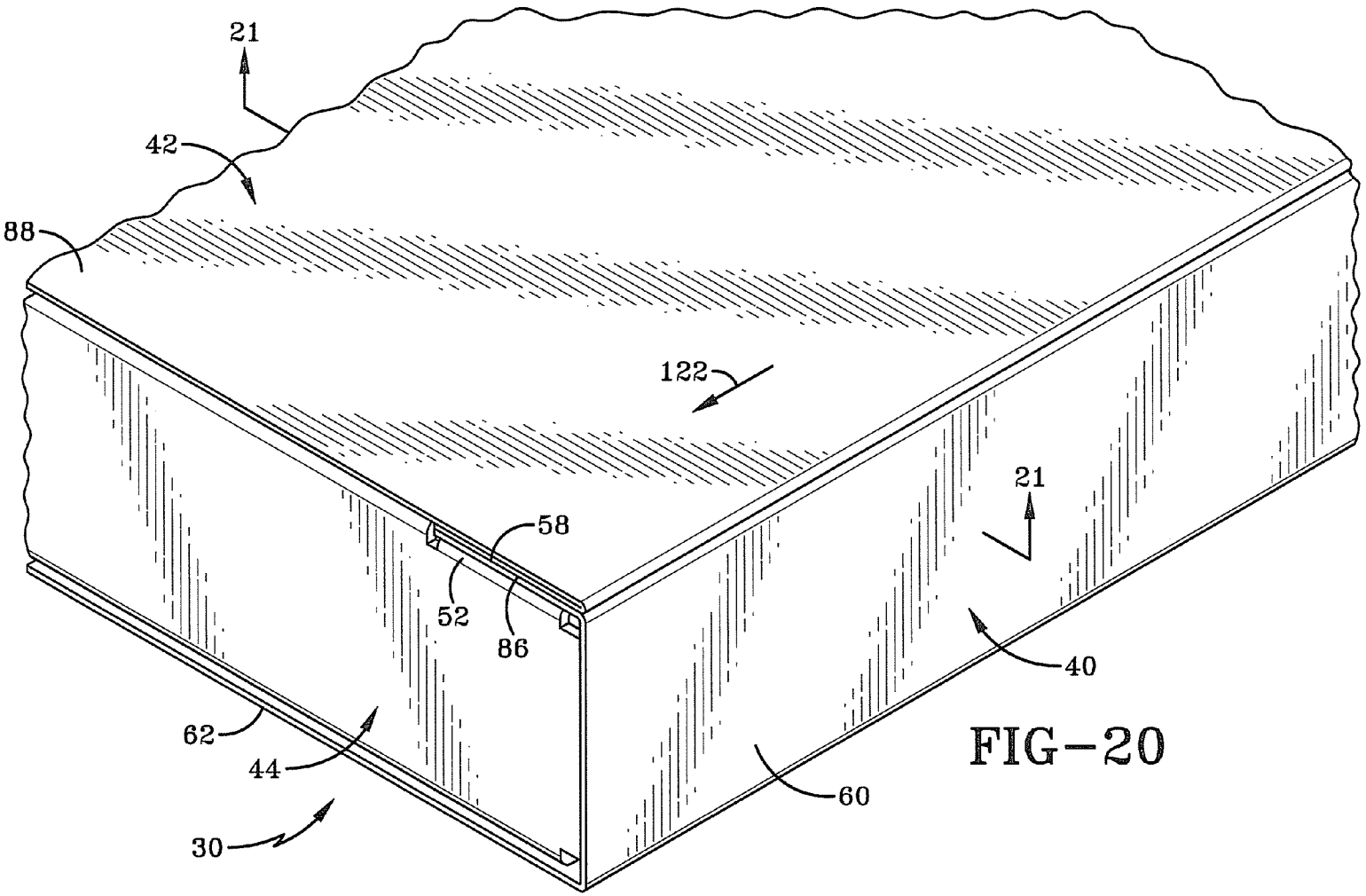
FIG. 20 is a perspective view of a corner of the first embodiment top skin secured to a combined base skin and end rail.

Averting now to FIGS. 19 and 20, where lower end cap 44 is shown inserted within base skin 40. Adhesive 118 is applied to the top of first wall 58 and lower end cap 44. Top skin 42 is then placed on top of adhesive 118 in the direction indicated by arrow 120 so that the protrusions 50 of top skin 42 (not shown) are located within the positioning portion of mounting slots 48. The top skin 42 is then slid in the direction indicated by arrow 122 to locate the top skin 42 protrusions 50 within the locking portion of the mounting slots 48. Advantageously, the top skin 42 protrusions 50 are secured within the locking portions by the downward force of gravity once the door assembly 30 is mounted in a doorway. Alternatively, adhesive 118 may be applied to top skin 42 directly and then installed onto the top of first wall 58 and end caps 44.

Figure 21:
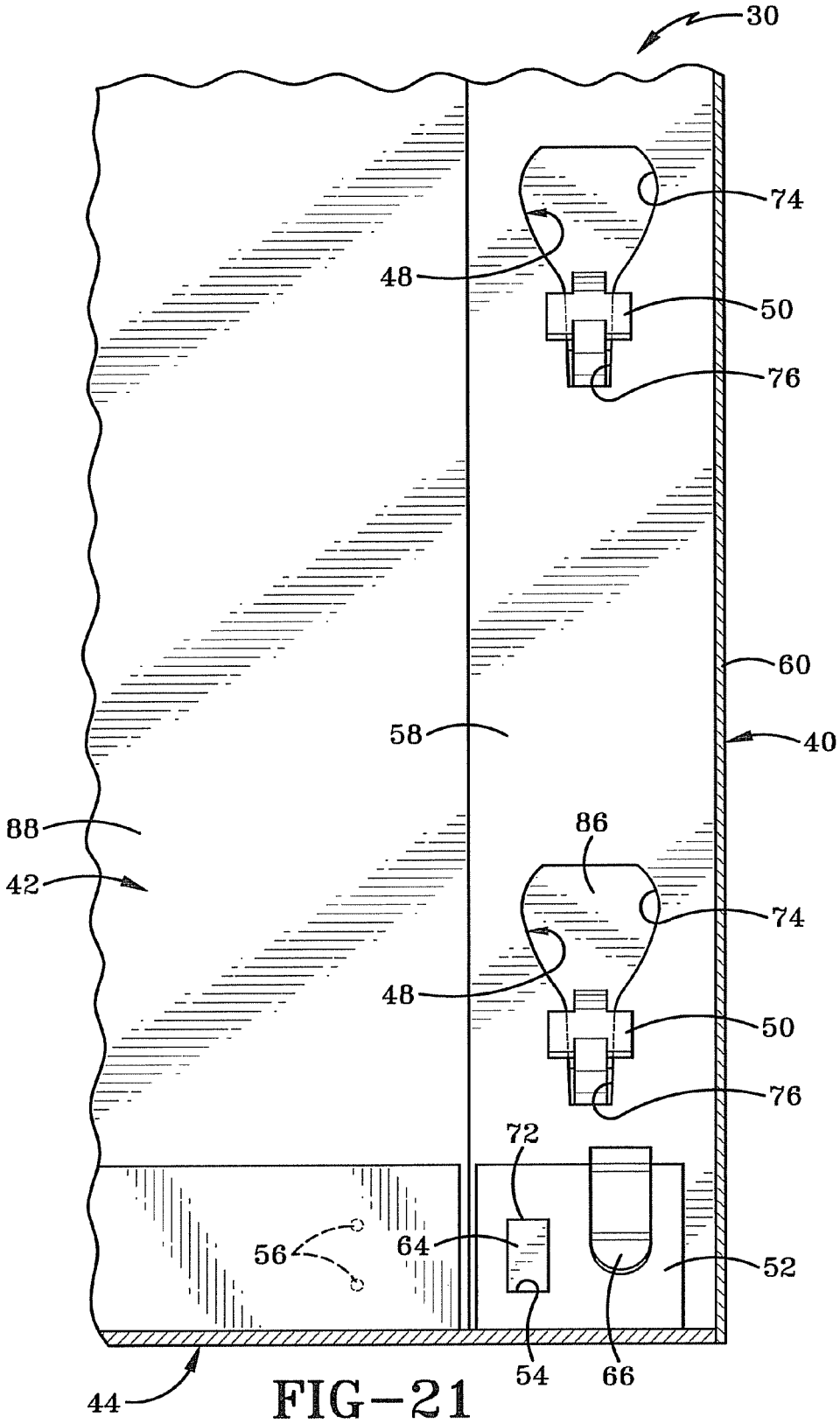
FIG. 21 is a sectional view of the first embodiment interlocking door assembly taken generally along line 21-21 in FIG. 20.
Figure 22:
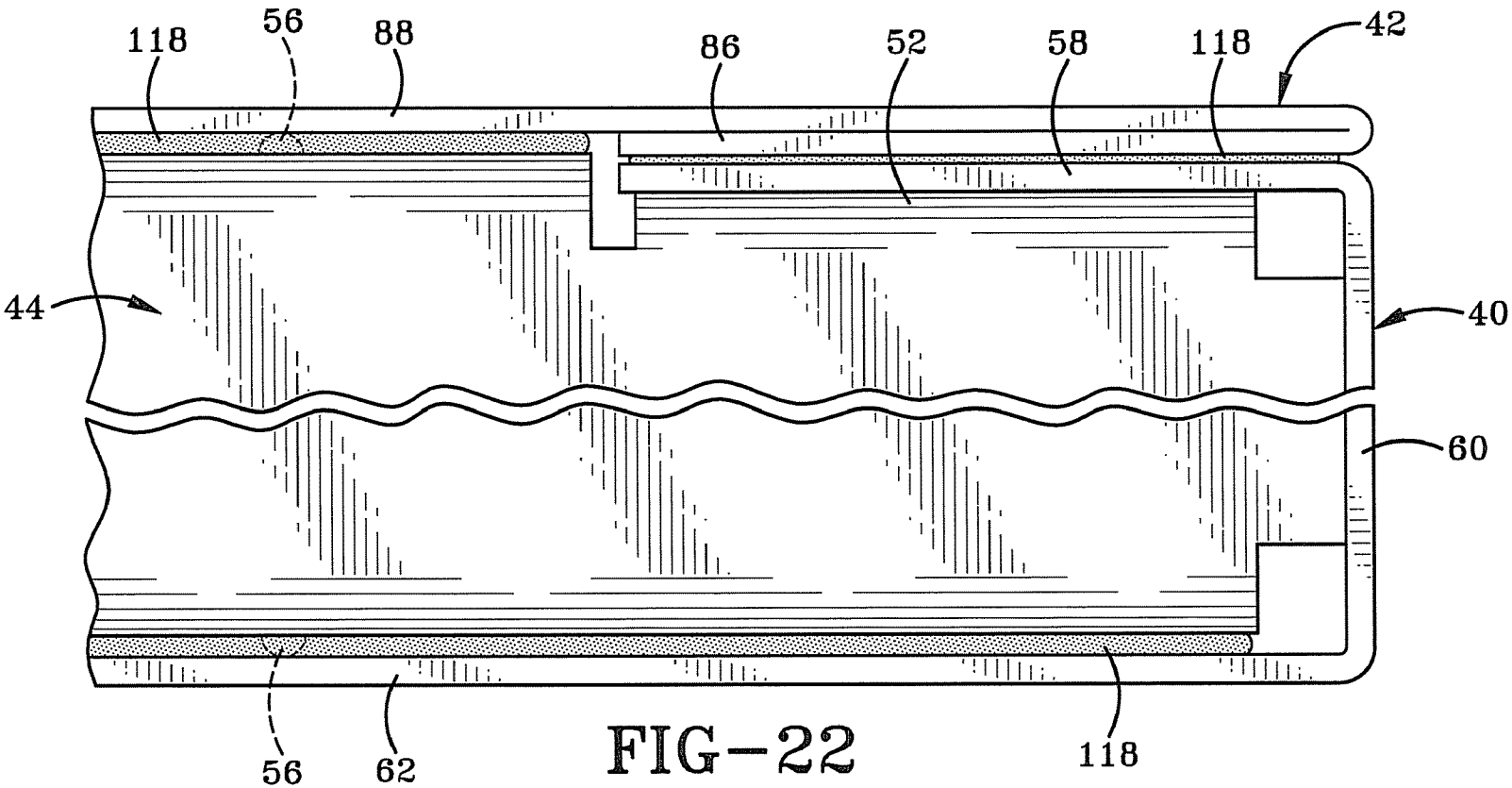
FIG. 22 is an enlarged endwise view of one side of the first embodiment end rail secured to the bottom of an interlocking door assembly.
Figure 23:
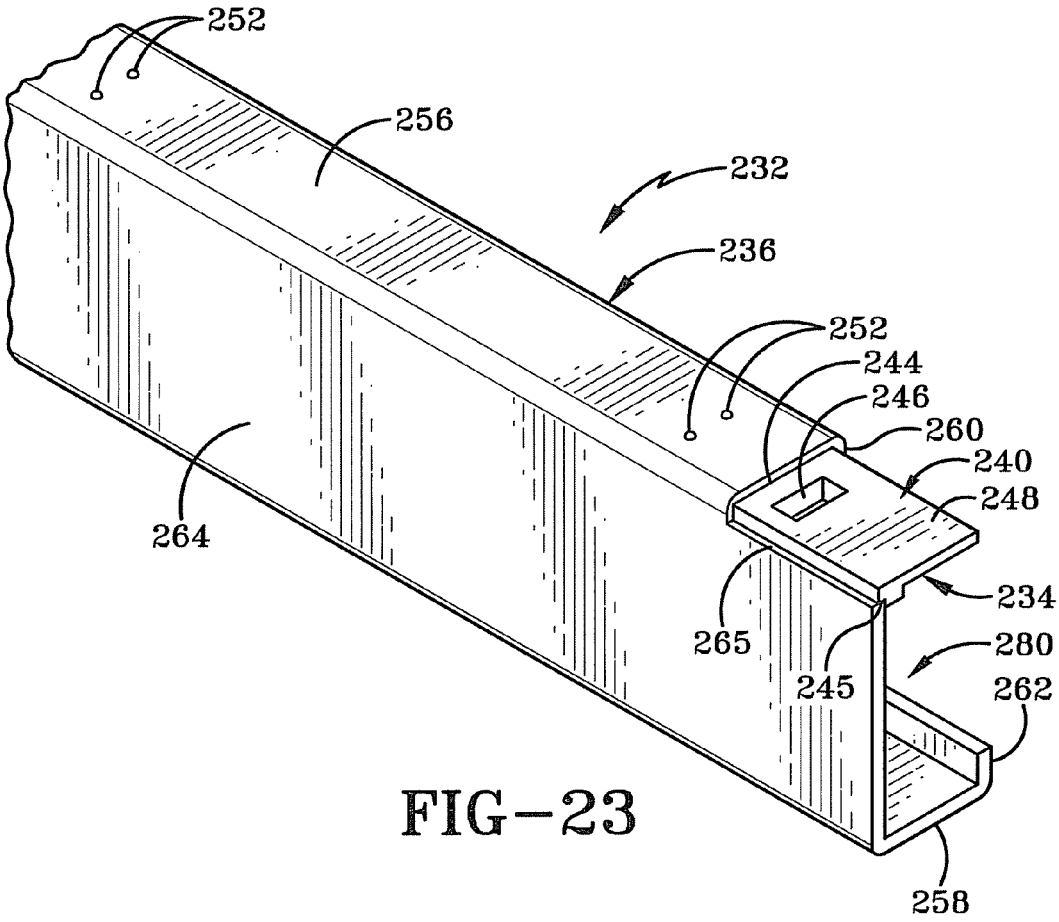
FIG. 23 is a perspective view of a second embodiment of the end cap of the door assembly.

Further, FIG. 21 is a sectional view of a first embodiment door assembly 30 with protrusions 50 secured within locking portion 76 of mounting slots 48. FIG. 22 is an enlarged endwise view of door assembly 30 with adhesive 114 and adhesive 118 fixedly securing the base skin 40, top skin 42, lower end cap 44, and upper end cap 46 of door assembly 30.

Having now described structure and a method of assembling the interlocking door, a method of manufacturing the door will be described in detail and should be viewed in light of FIGS. 1 though 22. Although the following is described as a series of steps, no particular order of steps is implied and as such is limited only by the appended claims.

Door assembly 30 is manufactured by stamping base skin 40 with locking tabs 64, mounting slots 48 having positioning portions 74 and locking portions 76, and side wall 60. Side wall 60 is then stamped with axial protrusions 80, sliding locks 82, and mounting holes 84. Hinge reinforcement plate 96 is then secured on axial protrusions 80 and sliding locks 82. Next, top skin 42 is stamped with protrusions 50 and end caps 44 and 46 are stamped with slots 54 and fastening ends 52. Adhesive 114 is then applied to an interior portion of base skin 40 and lower end cap 44 and upper end cap (not shown) are inserted within the base skin 40, respectively, and in contact with the adhesive. Adhesive 118 is then applied to a top side of lower end cap 44, upper end cap (not shown), and base skin 40 or to top skin 42. Next, protrusions 50 of the top skin 42 are disposed within mounting slots 48 and top skin 42 is in contact with adhesive 118. Finally, the top skin 42 and protrusions 50 are urged from positioning portion 74 to locking portion 76 in the direction indicated by arrow 122.

Accordingly, the interlocking door assembly is an effective, safe, inexpensive, and efficient device that achieves all the enumerated objectives of the invention, provides for eliminating difficulties encountered with prior art devices, systems, and methods, and solves problems and obtains new results in the art.

With reference to FIGS. 23-34, a second embodiment of the present invention is shown in door assembly 230. Door assembly 230 includes a lower end cap 232 and an upper end cap (not shown). It will be readily understood that lower end cap 232 and upper end cap are generally similar in shape and function, therefore only lower end cap 232 will be discussed herein. Lower end cap 232 is generally similar to lower end cap 44, however, rather than being formed from one solid piece of material, such as lower end cap 44, lower end cap 232 is formed by securing a locking clip 234 to a beam 236. Locking clip 234 is formed from a first material and beam 236 is formed from a second material, wherein first material and second material may be different, and wherein the first and second materials may be different from the overall door material used to form base skin 40 and top skin 42.

Figure 25:
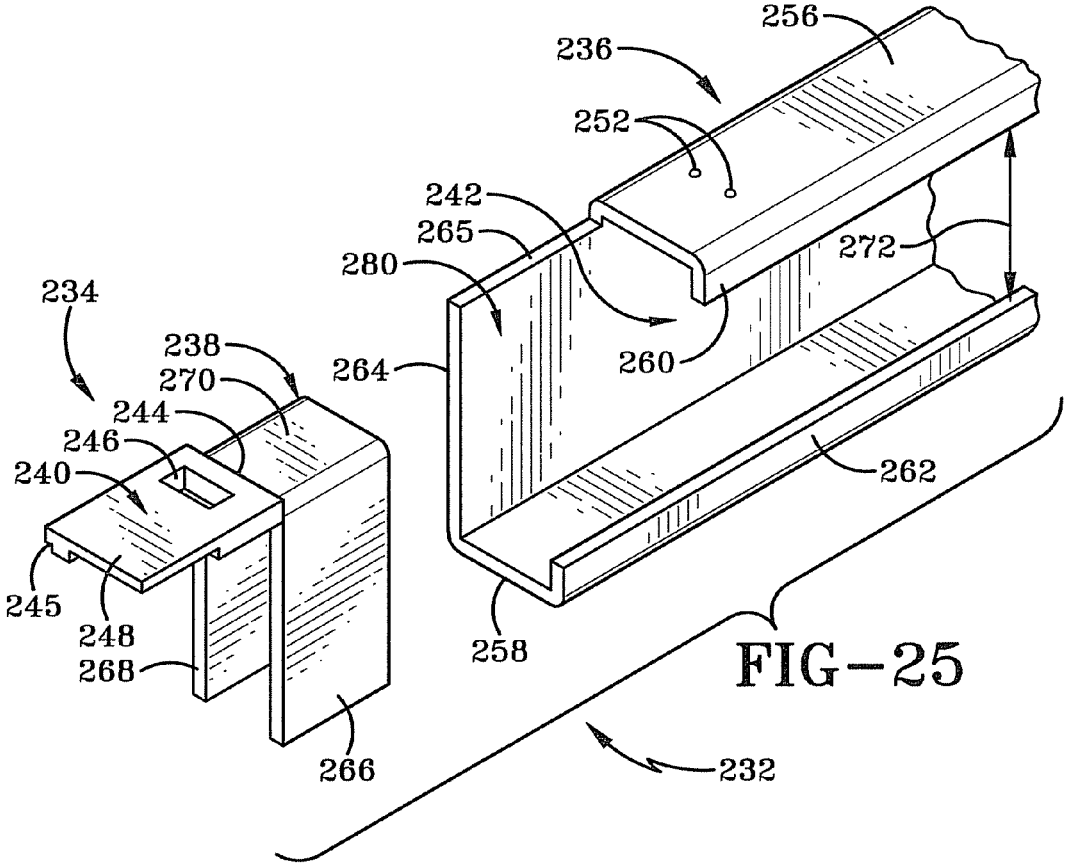
FIG. 25 is a perspective view of a locking clip and a beam which comprise the end cap of the second embodiment.
Figure 29:
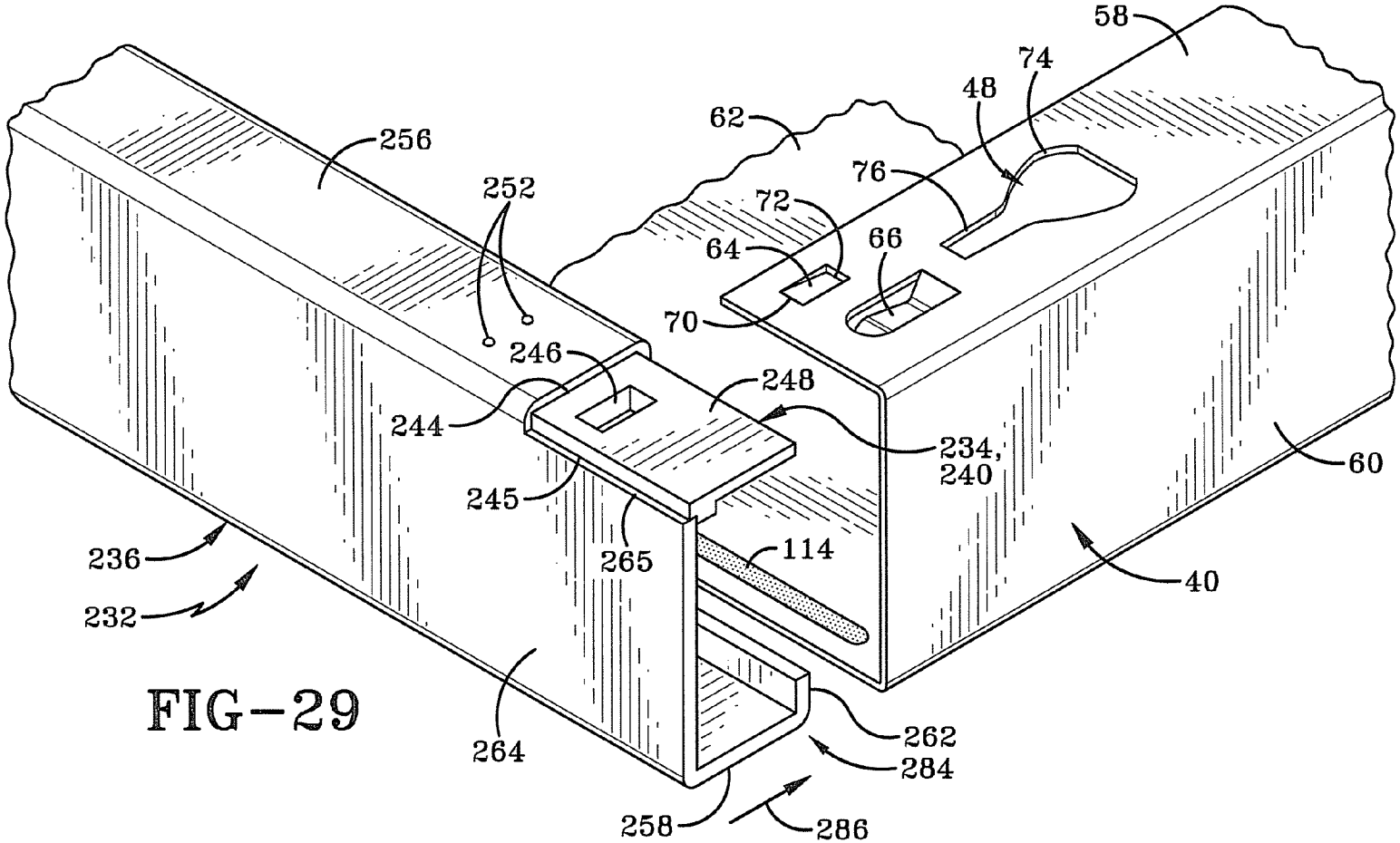
FIG. 29 is a perspective view of the end cap of the second embodiment and the base skin.
Figure 30:
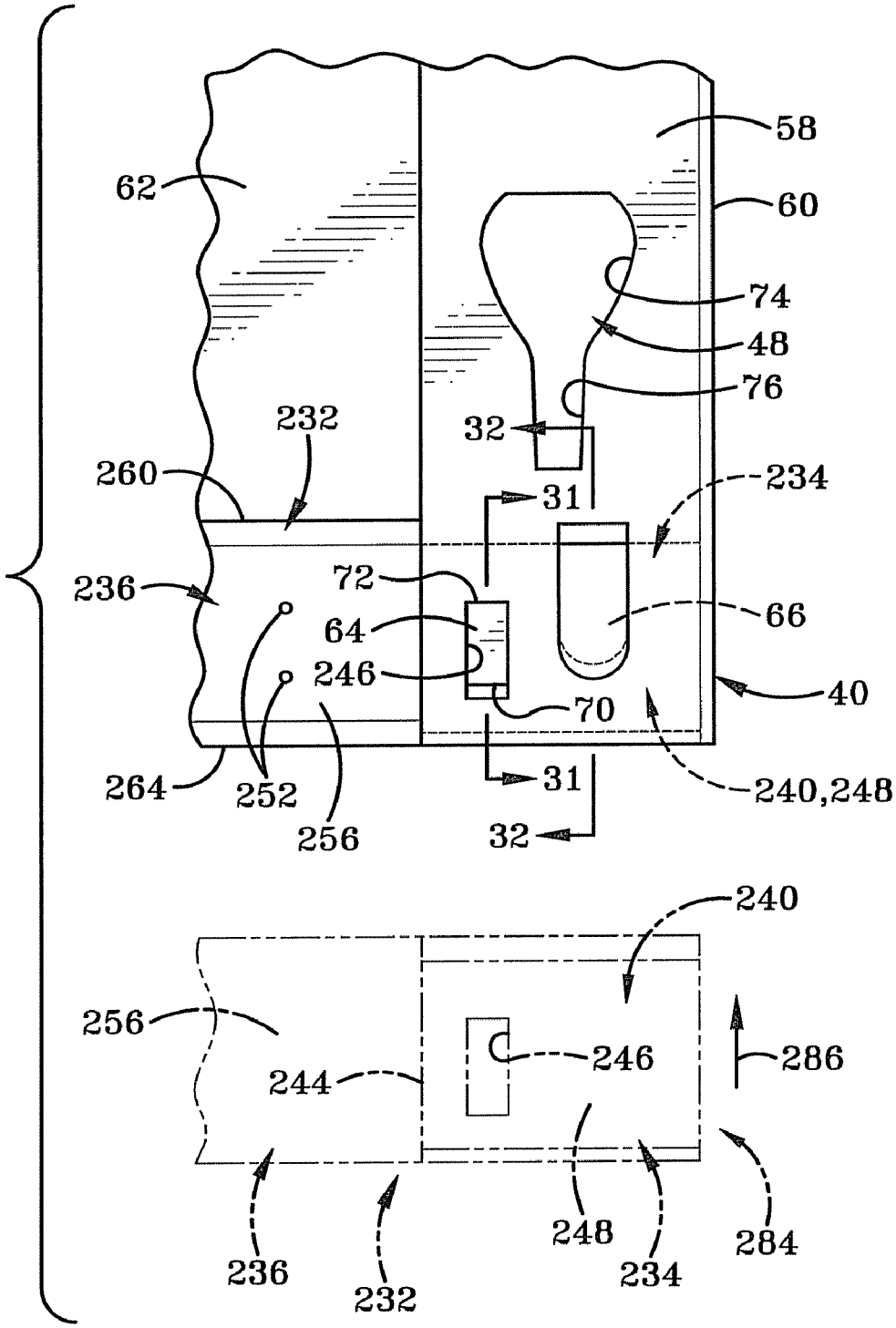
FIG. 30 is a top view similar to FIG. 29 showing the end cap in phantom.
Figure 31:
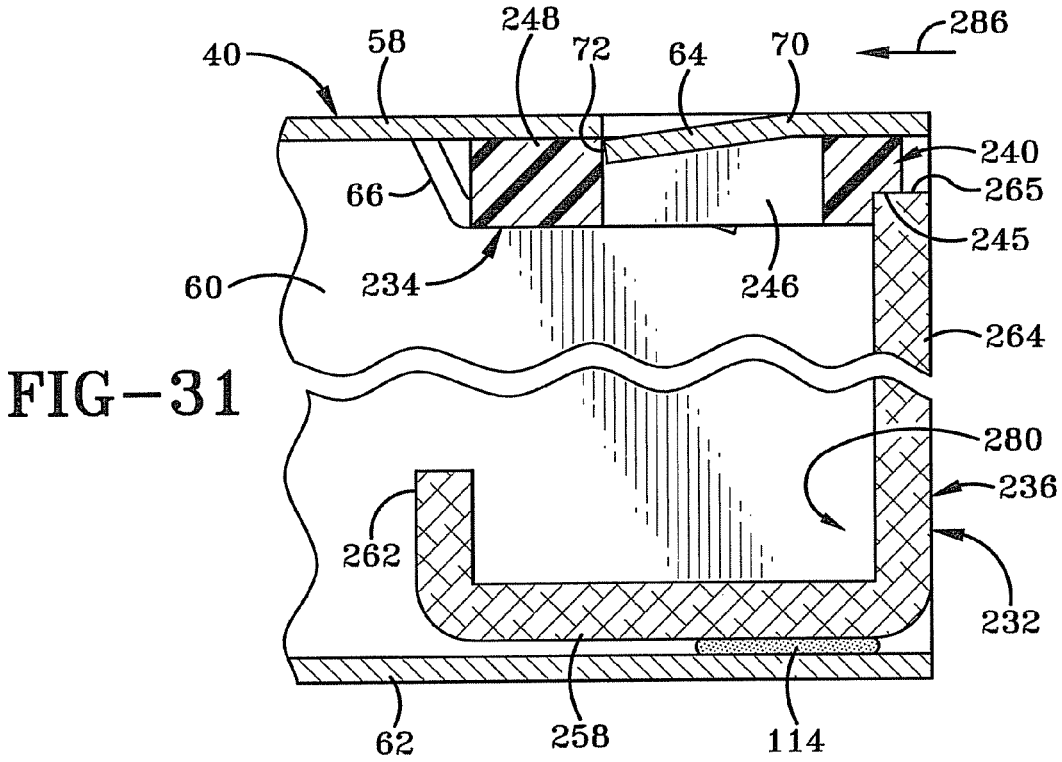
FIG. 31 is a cross-sectional view taken along line 31-31 of FIG. 30.
Figure 32:
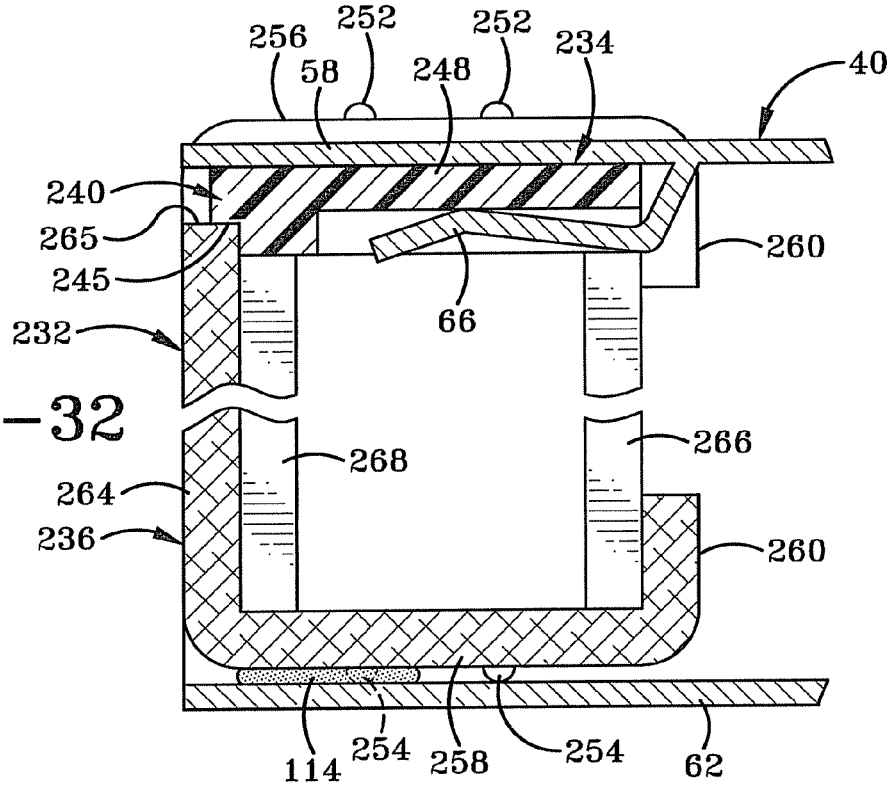
FIG. 32 is a cross-sectional view taken along line 32-32 of FIG. 30.
Figure 33:
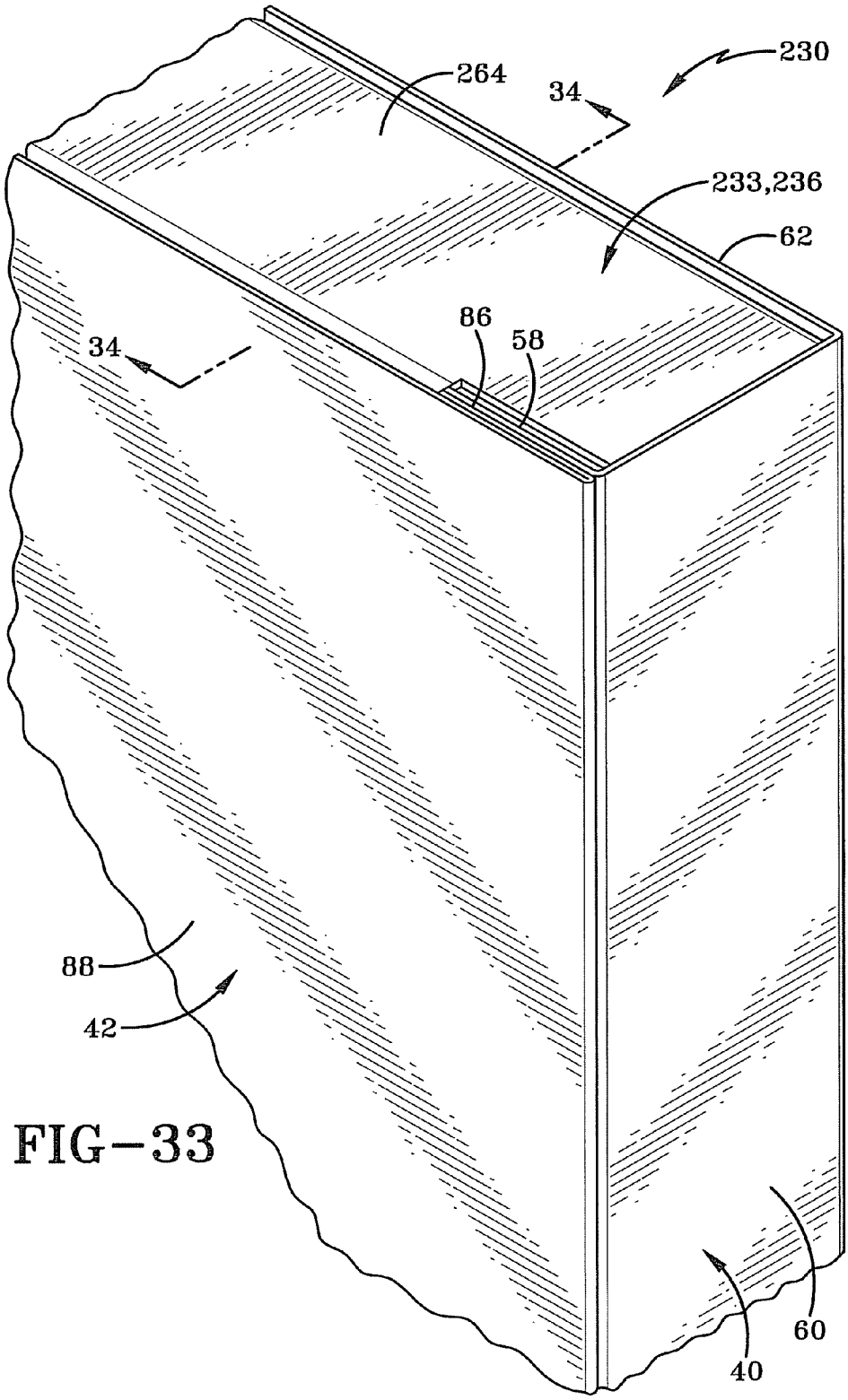
FIG. 33 is a perspective view of the second embodiment of the door assembly in the assembled state.
Figure 34:
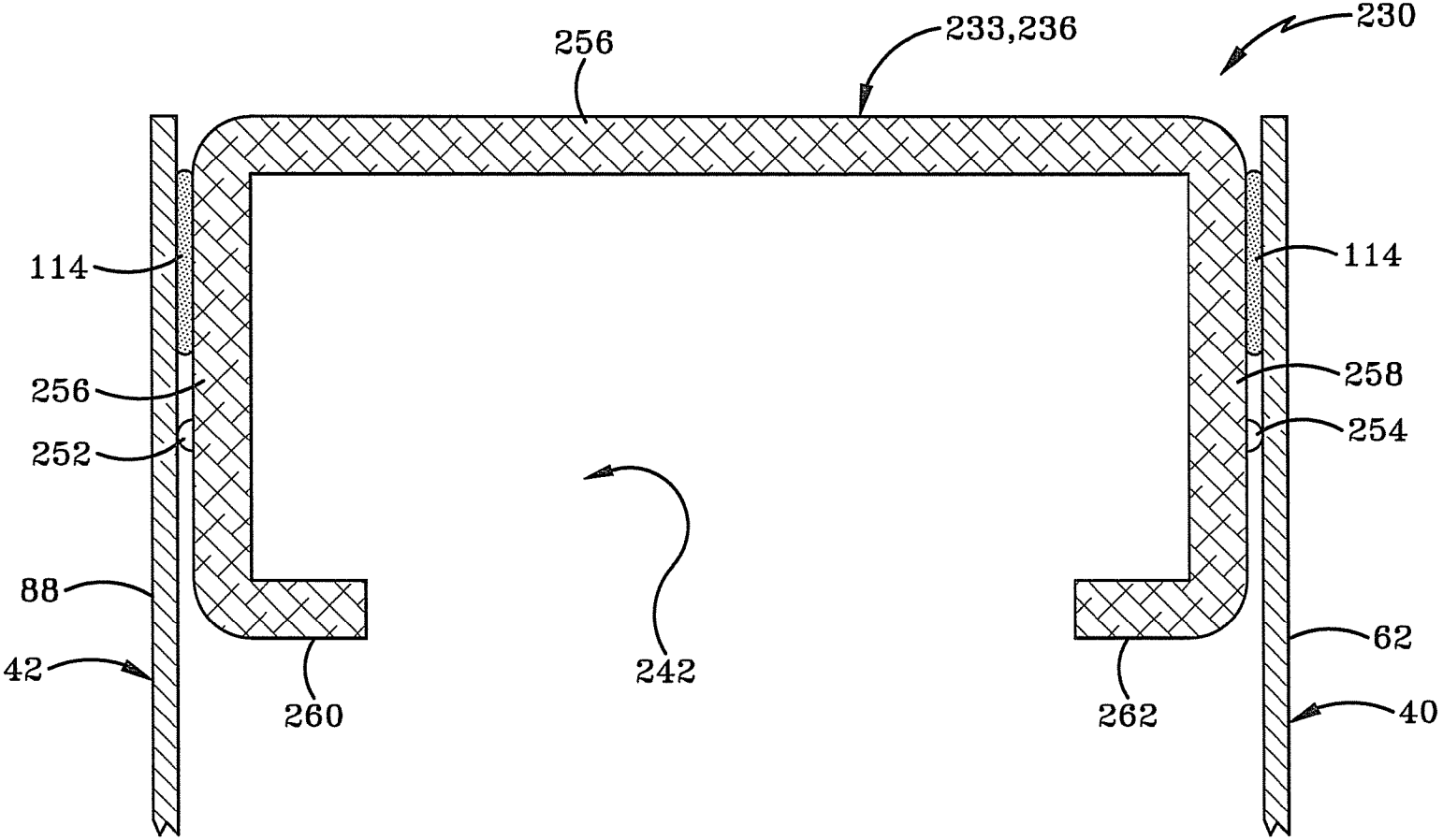
FIG. 34 is a cross-sectional view taken along line 34-34 of FIG. 33.

As shown in FIG. 25, locking clip 234 includes a base 238 and a flange 240 extending therefrom. Base 238 is a U-shaped member which includes an outer sidewall 266, an inner sidewall 268, and a top wall 270 extending therebetween. Flange 240 includes a first shoulder 244, a second shoulder 245, a locating ledge 248, and a slot 246 defined by locating ledge 248 which is similar in shape and form to slots 54 of lower end cap 44.

As shown in FIG. 25, beam 236 includes an upper retaining lip 260 adjacent an upper sidewall 256, a lower retaining lip 262 adjacent a lower sidewall 258, and a back wall 264 having an edge 265 and extending between upper sidewall 256 and lower sidewall 258. Upper retaining lip 260, lower retaining lip 262, upper sidewall 256, lower sidewall 258, and back wall 264 cooperate to define a channel 242 extending through beam 236. Channel 242 has a generally rectangular cross-sectional shape which is complementary shaped to the generally rectangular cross-sectional shape of base 238 of locking clip 234. Channel 242 is shown in FIG. 25 extending entirely through beam 236, however, channel 242 may terminate within beam 236 without departing from the spirit of the invention. A plurality of bosses 252 extend outwardly from upper sidewall 256, and a plurality of bosses 254 extend outwardly away from lower sidewall 258. While beam 236 is shown with a void 272 defined between upper retaining lip 260 and lower retaining lip 262, it will be readily understood that void 272 may be removed and filled with a continuous solid wall, or portions thereof, extending between upper retaining lip 260 and lower retaining lip 262 without departing from the spirit of the invention.

Figure 24:
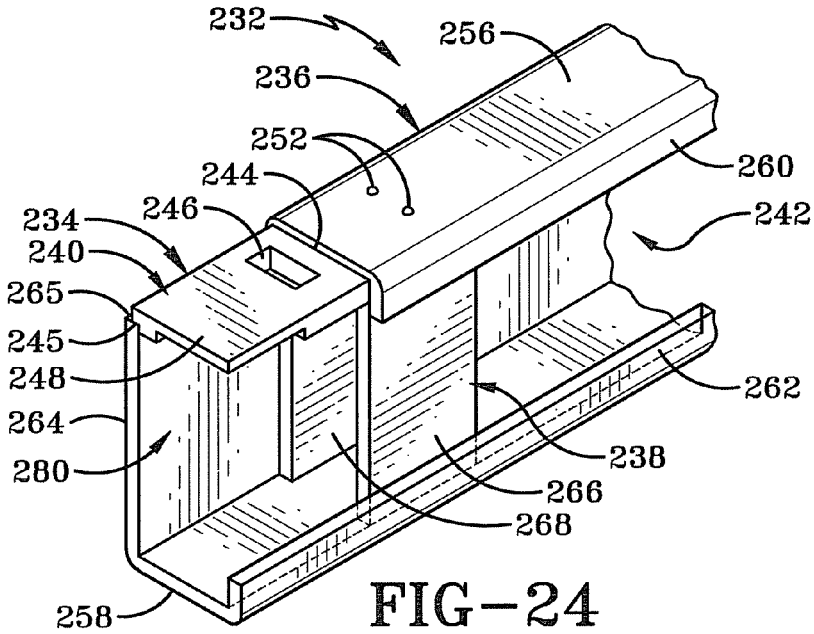
FIG. 24 is a perspective view of one end of the end cap.

As shown in FIG. 27, beam 236 generally extends along an imaginary longitudinal line 274 with upper sidewall 256 having a first longitudinal length 276 and lower sidewall 258 having a second longitudinal length 278. As seen in FIG. 25, first length 276 is shorter than second length 278, which creates a void 280 (FIG. 25) for flange 240 to fill when locking clip 234 is properly engaged with beam 236 (FIG. 24). As shown in FIG. 27, while locking clip 234 heretofore has been discussed with particularly reference to one end of beam 236, beam 236 includes a first end 282 and a second end 284, whereby void 280 may be defined at either first end 282 or second end 284, or both, depending on the desired configuration of the manufacturer. Thus, locking clip 234 or a pair of locking clips 234 may be employed in the second embodiment without departing from the spirit of the invention. Therefore, it will be readily understood that the manufacturer may wish to use a hybrid system for an end cap having locking clip 234 proximate one end of the hybrid beam, and fastening end 52 described in the first embodiment proximate the other end of the hybrid beam.

As shown in FIGS. 24-29, end cap 232 is assembled in the following manner. Inasmuch as the cross-sectional rectangular shape of base 238 is complementarily shaped to fit into the cross-sectional rectangular shape of channel 242, locking clip 234 is slidably engaged with beam 236 by way of base 238 fitting inside channel 242. Base 238 is prevented from sliding within channel 242 beyond the correct position by way of first shoulder 244 abutting upper sidewall 256 (FIG. 24). Second shoulder 245 is sized and positioned to receive edge 265 of back wall 264 therein and thereby form a firm abutment between flange 240 and back wall 264 when base 238 is received in channel 242. As shown in FIG. 24, when base 238 is positioned inside channel 242, outer sidewall 266 abuts lower retaining lip 262 as well as upper retaining lip 260. Likewise, inner sidewall 268 abuts back wall 264, and top wall 270 abuts upper sidewall 256 (FIG. 24).

End cap 232, when assembled in the above manner, operates in the same manner as lower end cap 44 as discussed above and is engaged with base skin 40 and top skin 42 in the same manner. End cap 232 is inserted into base skin 40 having fresh adhesive 114 disposed thereon, and is securely held thereto by way of slot 246 engaging locking tab 64 and locating ledge 248 engaging locating tab 66. Locating tab 66 prevents end cap 232 from progressing within base skin 40 beyond the desired position and ensures end cap 232 is properly aligned within door assembly 230. Bosses 252 and 254 operate to properly hold end cap 232 a specific distance away from base skin 40 and top skin 42, as discussed in the first embodiment with respect to bosses 56.

While end cap 232 operates generally similarly to end cap 44, end cap 232 has the advantages of being comprised of two separate components, namely locking clip 234 and beam 236. This allows the user or manufacturer to form locking clip 234 and beam 236 out of appropriate materials, which may be different for each element. Thus, a benefit is realized by separating end cap 232 into two elements. Locking clip 234 may be manufactured from a first material such as an elastomeric material, to utilize current injection molding techniques, and to more easily form slot 246. Likewise, beam 236 may be manufactured from a second material to provide certain desired thermal qualities to door assembly 230. Beam 236 may be formed of a low thermal conductivity material to provide a thermal break in the assembly. Thereby beam 236 reduces or prevents the flow of thermal energy between base skin 40 and top skin 42. Inasmuch as the general door frame is separated into two separate interior and exterior pieces, when base skin 40 and top skin 42 are joined with a less conductive material, temperature transfer between base skin 40 and top skin 42 are reduced. This produces an extremely thermally efficient door while also providing the manufacturer with separate door components which may be specifically tailored to the intended environment. As such, beam 236 may be formed of various materials having low thermal conductivity, such as plastic-based and fiberglass-based materials.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the interlocking door is constructed and used, the characteristics of the construction, and the advantageous new and useful results obtained; the new and useful structures, devices, elements, arrangement, parts, combinations, and methods are set forth in the appended claims.

The invention claimed is:

1. A metal door comprising:

a base skin having an integrally formed first mechanical connector and a locking tab;

a top skin having an integrally formed second mechanical connector configured to engage the first mechanical connector to mechanically secure the top skin to the base skin to define an opening;

a beam;

a locking clip configured to be partially received in the beam to form an end cap, the locking clip having a slot; and wherein the end cap is complementary shaped to be slidably received in the opening and the locking tab engageable with the slot to secure the end cap in the opening.

2. The metal door of claim 1, wherein the locking clip includes a base and a flange extending outwardly from the base, whereby the base slidably engages the beam to secure the locking clip thereto.

3. The metal door of claim 2, wherein the beam defines a channel extending therethrough which is complementarily shaped to receive the base of the locking clip therein.

4. The metal door of claim 3, wherein the flange includes a shoulder positioned to abut the beam when the base is received in the channel and to thereby prevent the flange from passing into the channel.

5. The metal door of claim 4, wherein the flange defines the slot.

6. The metal door of claim 5, wherein the flange includes a locating ledge and the base skin includes a locating tab, and wherein the locating ledge is received in the locating tab when the end cap is received in the opening to prevent the end cap from passing beyond the locating tab.

7. The metal door of claim 6, wherein the base skin includes a pair of first walls, a second wall, a pair of sidewalls, and wherein the pair of first walls and the second wall extend generally parallel to each other, and the pair of sidewalls extend generally perpendicular to the pair of first walls and the second wall, and the first mechanical connector is formed integrally with the pair of first walls.

8. The metal door of claim 7, wherein the locking tab is integrally formed with at least one of the first walls.

9. The metal door of claim 8, wherein the locating tab is integrally formed with at least one of the first walls.

10. The metal door of claim 9, wherein the top skin includes a first layer adjacent to a second layer, and wherein the second mechanical connector is integrally formed with the second layer.

11. The metal door of claim 10, wherein a first boss extends outwardly from the beam and abuts the first layer of the top skin when the end cap is secured in the opening, and a second boss extends outwardly from the beam and abuts the second wall of the base skin when the end cap is secured in the opening.

12. The metal door of claim 11, wherein the beam includes an upper sidewall, a back wall, and a lower sidewall, and wherein the first boss extends outwardly from the upper sidewall, and the second boss extends outwardly from the lower sidewall.

13. The metal door of claim 12, wherein the beam extends along an imaginary longitudinal line, the upper sidewall includes a first longitudinal length, the lower sidewall includes a second longitudinal length, and wherein the first longitudinal length is shorter than the second longitudinal length.

14. A metal door comprising:

a base skin having an integrally formed first mechanical connector and a locking tab;

a top skin having an integrally formed second mechanical connector configured to engage the first mechanical connector to mechanically secure the top skin to the base skin to define an opening;

a beam having a channel;

a locking clip having a base and a flange extending from the base, the flange having a shoulder and a slot, wherein the base is received in the channel forming an end cap whereby the shoulder abuts the beam to generally prevent the flange from passing into the channel; and wherein the locking tab engages with the slot to secure the end cap in the opening.

15. The metal door of claim 14, wherein the flange includes a locating ledge and the base skin includes a locating tab, and wherein the locating ledge is received in the locating tab when the end cap is received in the opening to prevent the end cap from passing beyond the locating tab.

16. The metal door of claim 15, wherein the base skin includes a pair of first walls, a second wall, a pair of sidewalls, and wherein the pair of first walls and the second wall extend generally parallel to each other, and the pair of sidewalls extend generally perpendicular to the pair of first walls and the second wall, and the first mechanical connector is formed integrally with the pair of first walls.

17. The metal door of claim 16, wherein the top skin includes a first layer adjacent to a second layer, and wherein the second mechanical connector is integrally formed with the second layer.

18. The metal door of claim 17, wherein a first boss extends outwardly from the beam and abuts the first layer of the top skin when the end cap is secured in the opening, and a second boss extends outwardly from the beam and abuts the second wall of the base skin when the end cap is secured in the opening.

19. The metal door of claim 18, wherein the beam includes an upper sidewall, a back wall, and a lower sidewall, and wherein the first boss extends outwardly from the upper sidewall, and the second boss extends outwardly from the lower sidewall.

20. A metal door comprising:

a base skin having an integrally formed first mechanical connector and a locking tab;

a top skin having an integrally formed second mechanical connector configured to engage the first mechanical connector to mechanically secure the top skin to the base skin to define an opening;

a beam having a channel;

a locking clip having a base and a flange extending from the base, wherein the base is received in the channel forming an end cap and the shoulder abuts the beam to generally prevent the flange from passing into the channel; and wherein the locking tab engages with the flange to secure the end cap in the opening.

* * * * *